US006120029A

United States Patent [19]

Carmichael et al.

[11] Patent Number: 6,120,029

[45] Date of Patent: Sep. 19, 2000

[54] EDUCATIONAL GAME FOR TEACHING CHESS THROUGH EXAMPLE

[75] Inventors: Craig G. Carmichael, 247 N. Sheldon Apt. 33; Brian Lee Boyd, 2101 Oakwood Rd. #205, both of Ames, Iowa 50014

[73] Assignees: Craig G. Carmichael, Ames, Iowa; Brian Lee Boyd, Eagan, Minn.

[21] Appl. No.: 08/880,951

[22] Filed: Jun. 23, 1997

[51] Int. Cl.[7] ..... A63F 3/02

[52] U.S. Cl. ..... 273/260

[58] Field of Search ..... 273/260, 261, 273/283

[56] References Cited

U.S. PATENT DOCUMENTS

| | | | |
|---|---|---|---|
| 3,406,975 | 10/1968 | Berger | 273/283 |
| 3,794,326 | 2/1974 | Bialek | 273/260 |
| 3,881,731 | 5/1975 | Droney | 273/260 X |
| 3,908,999 | 9/1975 | Brown | 273/260 |
| 4,079,941 | 3/1978 | Morales | 273/283 X |
| 4,927,157 | 5/1990 | Riihiluoma . | |
| 5,011,159 | 4/1991 | Fortunato . | |
| 5,197,742 | 3/1993 | Bendit | 273/283 X |
| 5,257,787 | 11/1993 | Miccio . | |
| 5,275,414 | 1/1994 | Stephens . | |
| 5,413,352 | 5/1995 | Persidsky et al. | 273/283 X |
| 5,490,675 | 2/1996 | Persidsky et al. | 273/283 X |
| 5,536,014 | 7/1996 | Serfozo | 273/260 |

OTHER PUBLICATIONS

Petty Chess, published in Sep. 1930 B. Walker Watson issue of the British Chess Magazine.

*Primary Examiner*—William E. Stoll

[57] ABSTRACT

A chess-like game method and apparatus are disclosed. The game includes a gameboard (10) or gameboard representation having a central chess board (20) capable of occupation by two sets of chess pieces, one light and the other dark. A chess-move storage device stores representations of example moves by the chess pieces on the chess board (20). A randomizing means is utilized to introduce the element of chance and to assign a prediction regarding the type of chess piece which will be captured next according to the example moves. After this prediction is assigned, the example moves by the chess pieces result in a captured chess piece. If the captured chess piece matches the selected prediction, then the piece is scored. Otherwise, it is temporarily stored in a corral (40) or its equivalent for later scoring opportunities. The game is played by one or multiple players, depending on the chosen embodiment. In playing marker embodiments, playing markers (12) are driven around a game track (30) by dice, some having chess piece designations thereon. Chess dice (14) and chess symbol spots (34) function as part of the randomizing means for this embodiment. In a playing card embodiment, predictions are made by placing playing cards (100) that were drawn from a draw pile (102) on top of the nearest play pile (104). The randomizing means for this embodiment is playing cards (100). An efficient indexing system and chess-move storage device are disclosed for the playing marker and playing card embodiments. In addition to the software equivalents of the above embodiments, a similar software technique is disclosed that trains players to quickly visualize possible chess movements.

3 Claims, 15 Drawing Sheets

EDUCATIONAL GAME FOR TEACHING CHESS THROUGH EXAMPLE

BACKGROUND—FIELD OF INVENTION

This invention relates to the game of chess, and more specifically to a chess-like game utilizing an improved method of teaching chess, particularly to children.

BACKGROUND—DESCRIPTION OF THE PRIOR ART

Typically the game of chess is played on a checker-like board having eight squares in each row, which are alternately light and dark colored. There are eight horizontal and eight vertical rows, so as to provide a total of 64 squares on the conventional chess board. Each of the two players in the conventional chess game starts with sixteen pieces: a king, a queen, two each of a bishop, knight and rook, and eight pawns. The object of the game is to check mate the opponent's king, that is, to place the king in such a position that it cannot avoid being taken by the opponent's next move. The various other pieces on the game board are provided for both offensive and defensive protection of the king.

Chess has been shown to have potential as an educational tool. It can enhance memory and higher-order thinking skills, develop self-confidence, and improve academic achievement. Many parents who know how to play the game would thus encourage their child to learn how to play chess.

The main difficulty in teaching the classic game of chess to children is the fact that chess can seem extremely complex and intimidating to the beginner. Because of this, the beginner may become discouraged prematurely and no longer wish to play chess.

For this reason, we have determined that a substantial reduction in complexity of the game's format is necessary for optimal learning of chess. Also, in order to preserve the true nature of conventional chess, the complexity must be reduced in a way that does not necessarily alter the standard number of chessmen, the standard chess piece movement, and the standard chess board format.

Various modifications of the chess game have previously been proposed to make the game more complex and challenging. Examples of such games are U.S. Pat. No. 4,504,060 to Rihilsoma, et al. U.S. Pat. No. 3,656,756 to Gribbon, Jr., U.S. Pat. No. 3,684,285 to Kane, U.S. Pat. No. 3,767,201 to Harper et al. and U.S. Pat. No. 3,794,326 to Bialek. However, whereas those games have been directed to increasing the complexity of basic chess so as to present a more challenging environment for experienced players, our invention substantially simplifies the game to readily facilitate its teaching for those wishing to learn chess, particularly children.

Attempts have been made at simplifying the game of chess. A notable example is U.S. Pat. No. 5,257,787 to Miccio (1993) which describes a board game that deviates from the conventional rules of chess, alters the board size and the number of chessmen. The board's reduction to 30 squares coupled with a 20-piece initial setup allows for severe restriction of piece movement which may easily leave a player with no good move. Children still have to learn the movements of each piece before play can begin. Even after learning this, the beginner has too many degrees of freedom to see the big picture at first, leaving the novice initially with no clear-cut strategy. Since the game is based entirely on skill and since skill levels between players are rarely matched equally, the novice may become discouraged prematurely and no longer wish to play even this simplified version of chess. Also, the game is restricted to only two players, and the player who is allowed the first move of the game may easily have a distinct positional advantage over the other player regardless of the skill level involved. Eleven out of the fourteen claims in this patented game exactly describe Petty Chess, which was actually invented by B. Walker Watson in 1930, and first published in the September 1930 issue of the British Chess Magazine. Two of the remaining three claims just add castling, and the remaining claim positions the major pieces in a different initial order.

It is worth noting that this kind of modified chess play is still not standard chess. If it were exactly standard, it could not have been patented. But as it is, the invention does not also provide a physical transitional means to the standard. The end result is a playing mechanism that may not reach its full potential simply because it teaches a variation of chess instead of the very well-established game of chess. Although, in theory, this modified chess play may be considered transitional for children, the consumer may simply see it as a variation from the standard. This kind of initial response is all that is necessary for a product not to sell.

U.S. Pat. No. 4,927,157 to Riihiluoma (1990) discloses a similar chess-like game. It also attempts to simplify conventional chess by reducing complexity and speeding up play. However, it does so by deviating from the standard chess format. The chess board playing surface is modified and the number of chessmen is reduced. The number of players is restricted to two. Also, a die is utilized to introduce the element of chess. However, the players still have to decide where to place the chess piece that was determined by the roll. Therefore, a complete knowledge of legal chess maneuvers is still needed for the four types of playing pieces before play can begin.

U.S. Pat. No. 5,011,159 to Fortunato (1991) shows a method of playing a board game combining chess, dice and money. The game utilizes a standard chess board, standard movement of chess pieces, and the standard number of chessmen. Luck is an integral part of the game, which may in itself prevent consecutive lop-sided games and thus keep players from becoming discouraged prematurely. Direct feedback is provided through the use of monetary rewards, which may help the beginner see some immediate objective. However, the learning overhead required to initially play the game is even greater than that of standard chess. Also, the game is limited to only two players.

U.S. Pat. No. 5,275,414 to Stephens et al. (1994) shows a method for playing team chess. The game of chess is altered by significantly increasing the board size and the number of playing pieces, and the rules deviate from the conventional rules of chess. Thus each game can become extremely complex and can last a very long period of time. Although this method of chess play can provide a positive group experience for experienced players, it is by no means an efficient method of learning how to play chess.

The previously cited chess-like games have all been directed in some way or another towards significantly deviating from chess, in each case necessarily teaching players a variation from the standard.

OBJECTS AND ADVANTAGES

Accordingly, several objects and advantages of our chess-like game are:

- to provide a fun chess teaching method that facilitates a gradual understanding of the game of chess;
- to provide a fun means for enticing players to pay attention to the teaching method;

to limit the amount of learning overhead necessary before play can begin;

to limit the amount of time required to play a complete game;

to still teach standard chess, not necessarily a variation thereof;

to prevent win lop-sidedness by introducing the element of chance;

to provide a positive group experience for inexperienced players while simultaneously making the game much less complex than the game of chess.

Further objects and advantages are to provide such a simple means of teaching chess that it allows young children to play with very little parental supervision, and to allow players to use their current chess aptitude to their advantage.

Further objects and advantages of our invention will become apparent from a consideration of the drawings and ensuing description.

DRAWING FIGURES

In the drawings, closely related figures have the same number but different alphabetic suffixes.

Figure 5A:
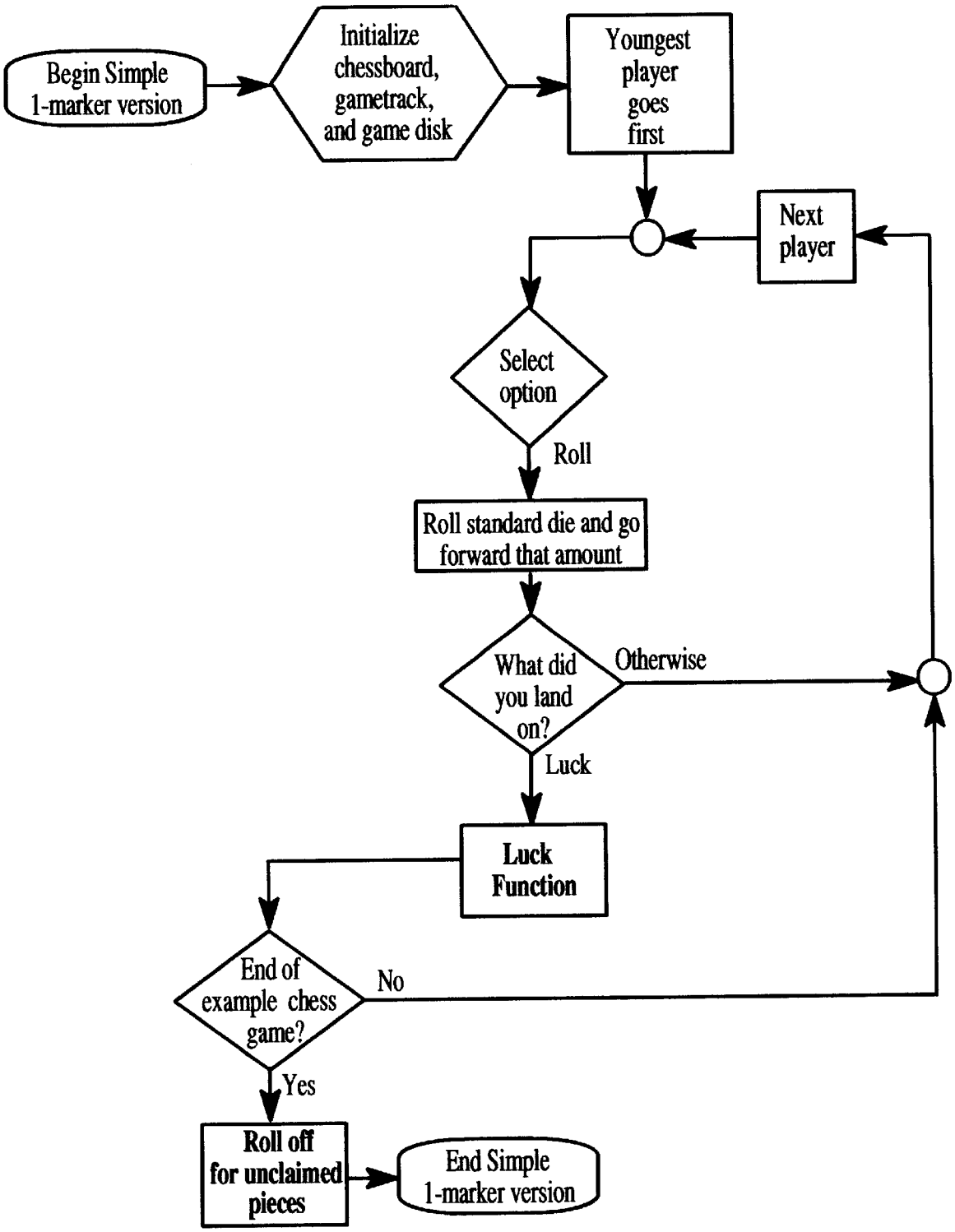

FIG. 5*a* is a flowchart depicting the operation of an embodiment of the present invention.

Figure 5B:
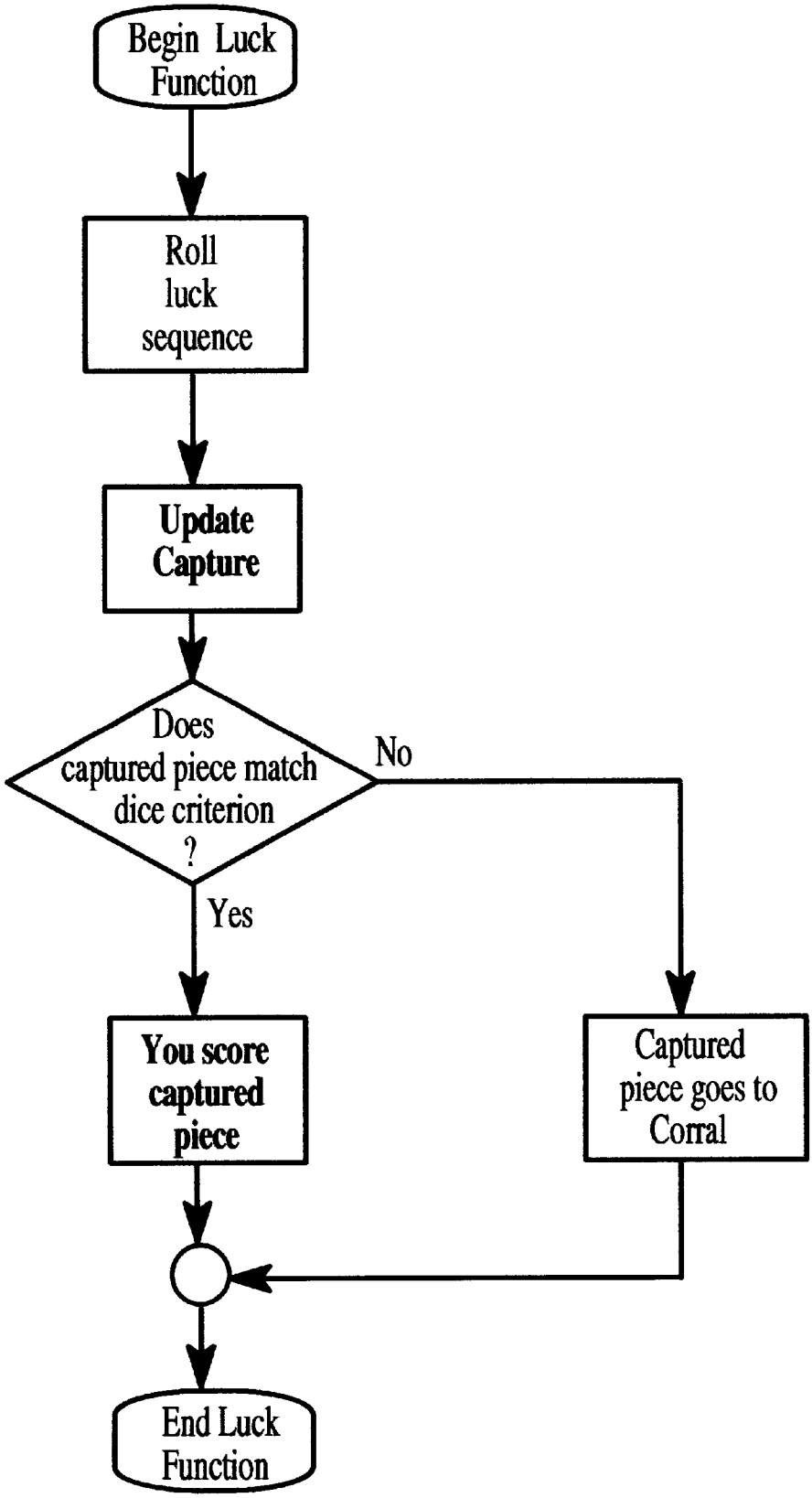

FIG. 5*b* is a flowchart depicting rule logic referred to in FIG. 5*a*.

Figure 6A:
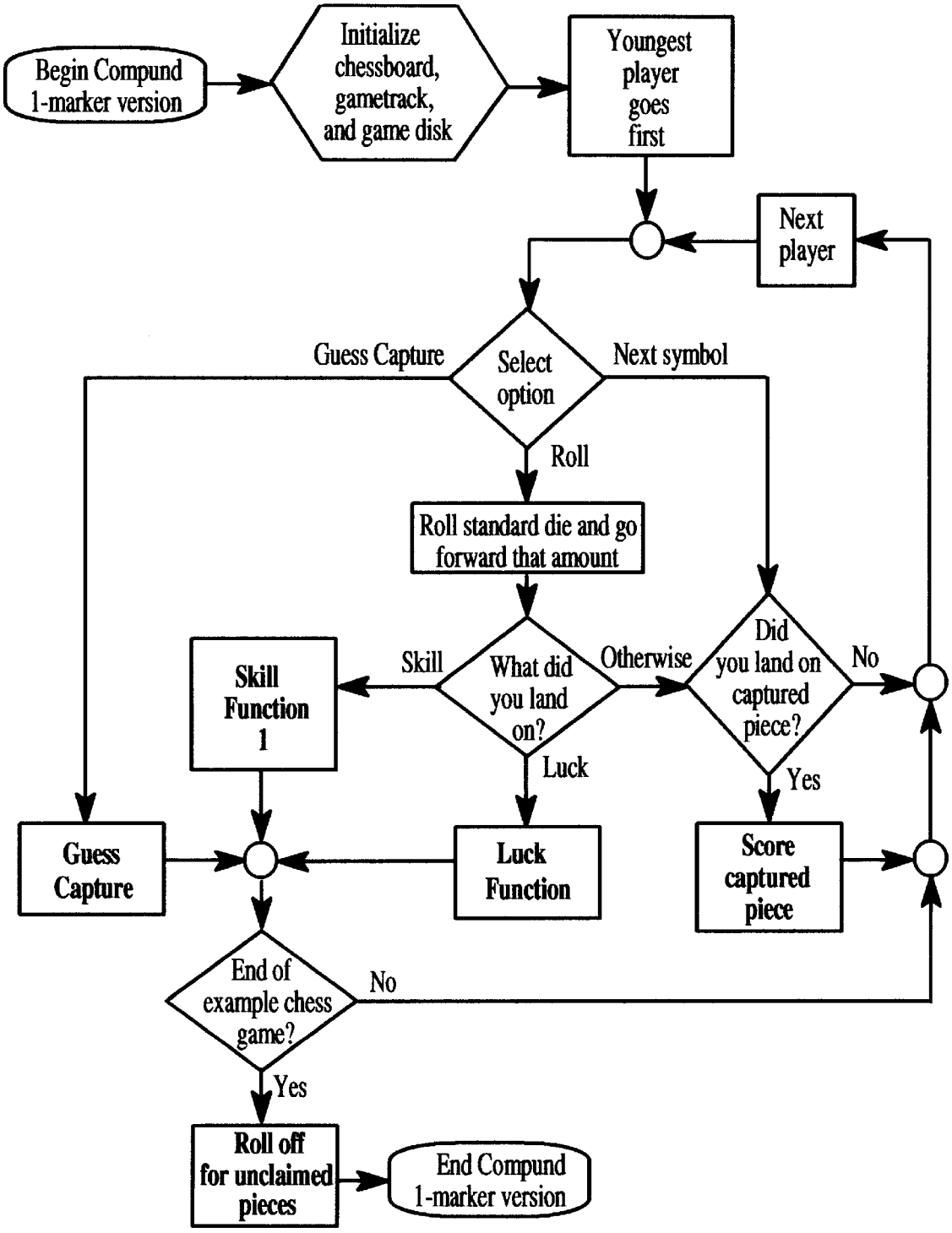

FIG. 6*a* is a flowchart depicting the operation of another embodiment or playing level of the present invention.

Figure 6B:
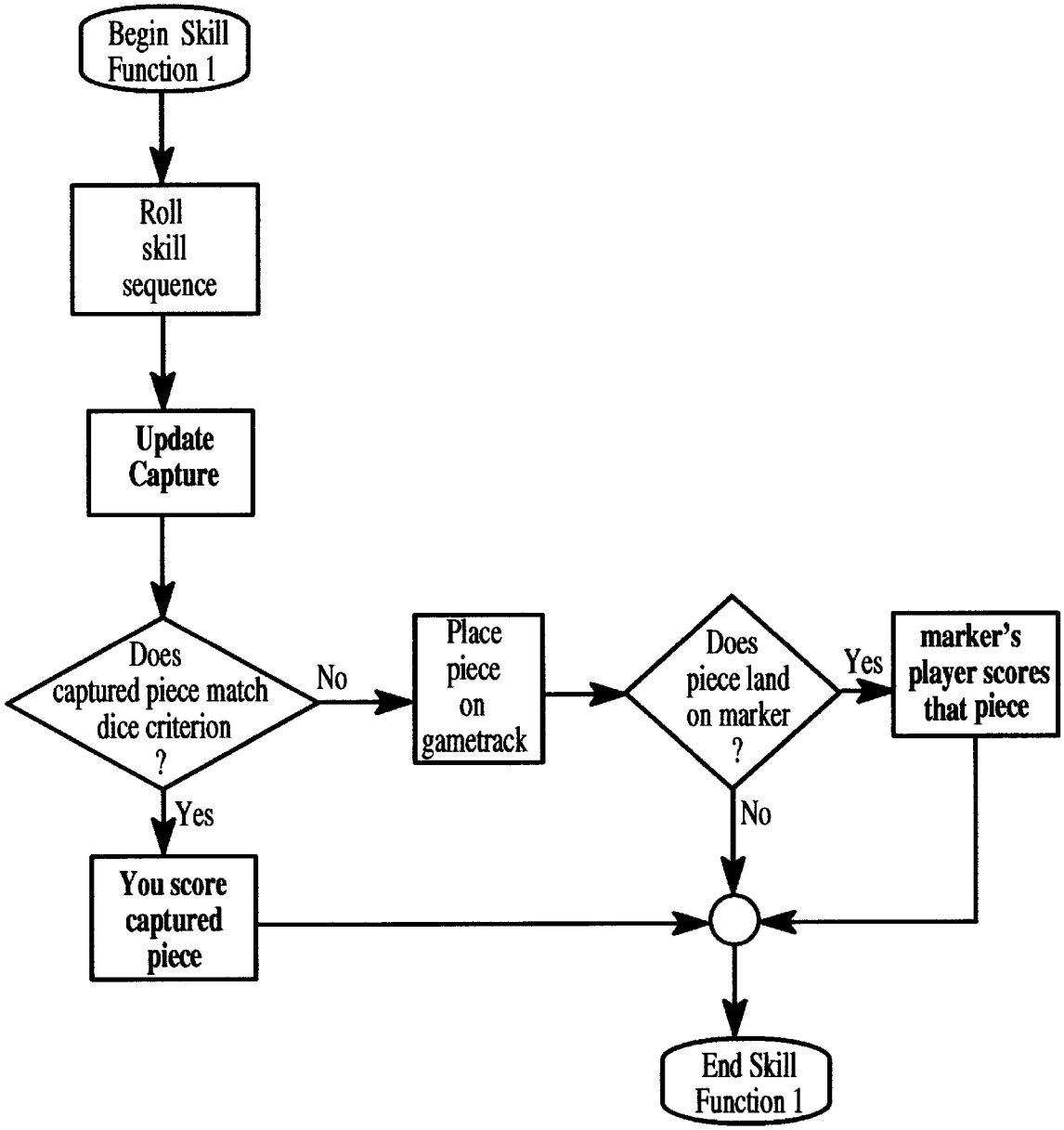
Figure 6C:
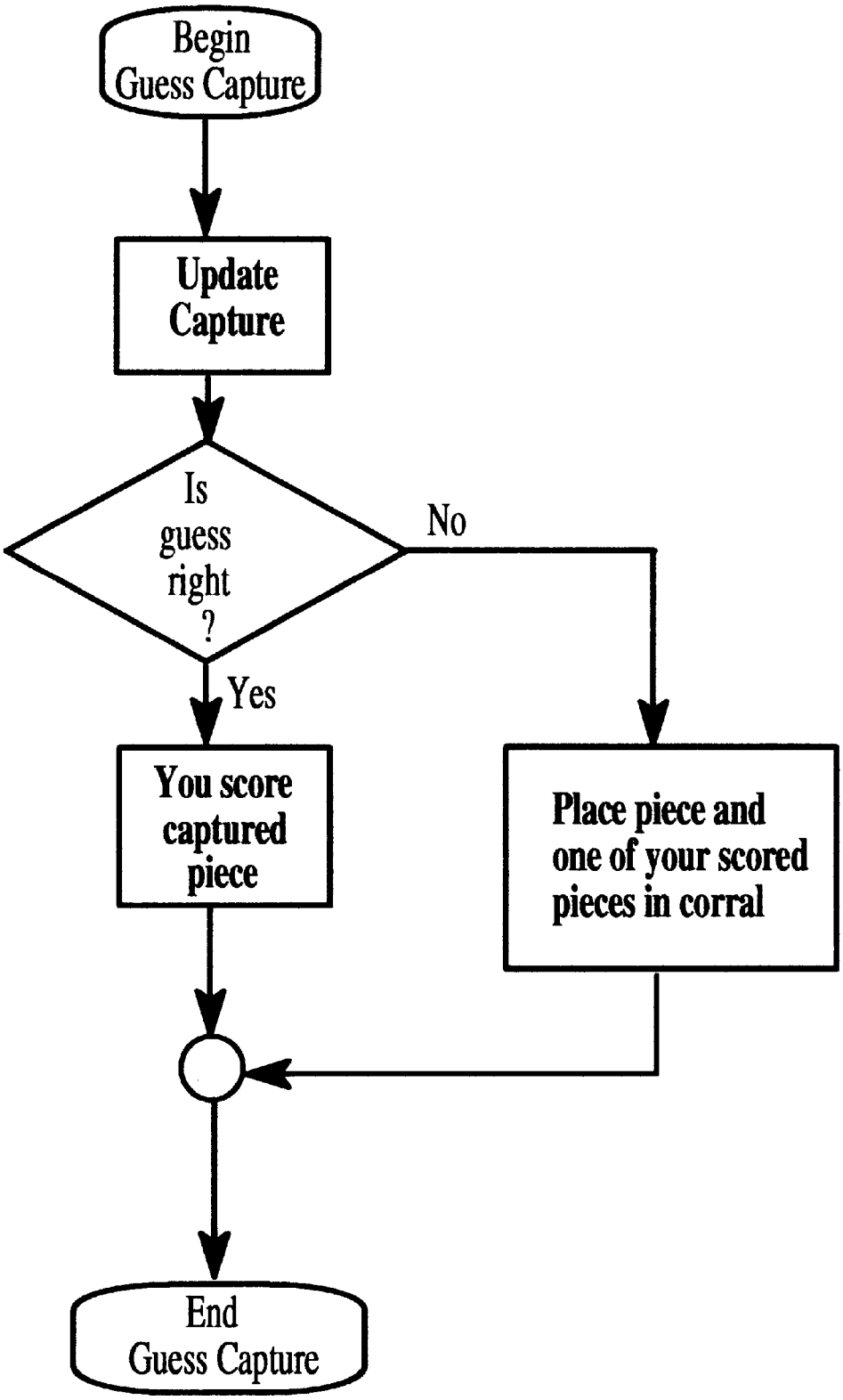

FIGS. 6*b* and 6*c* are flowcharts depicting rule logic referred to in FIG. 6*a*.

Figure 7A:
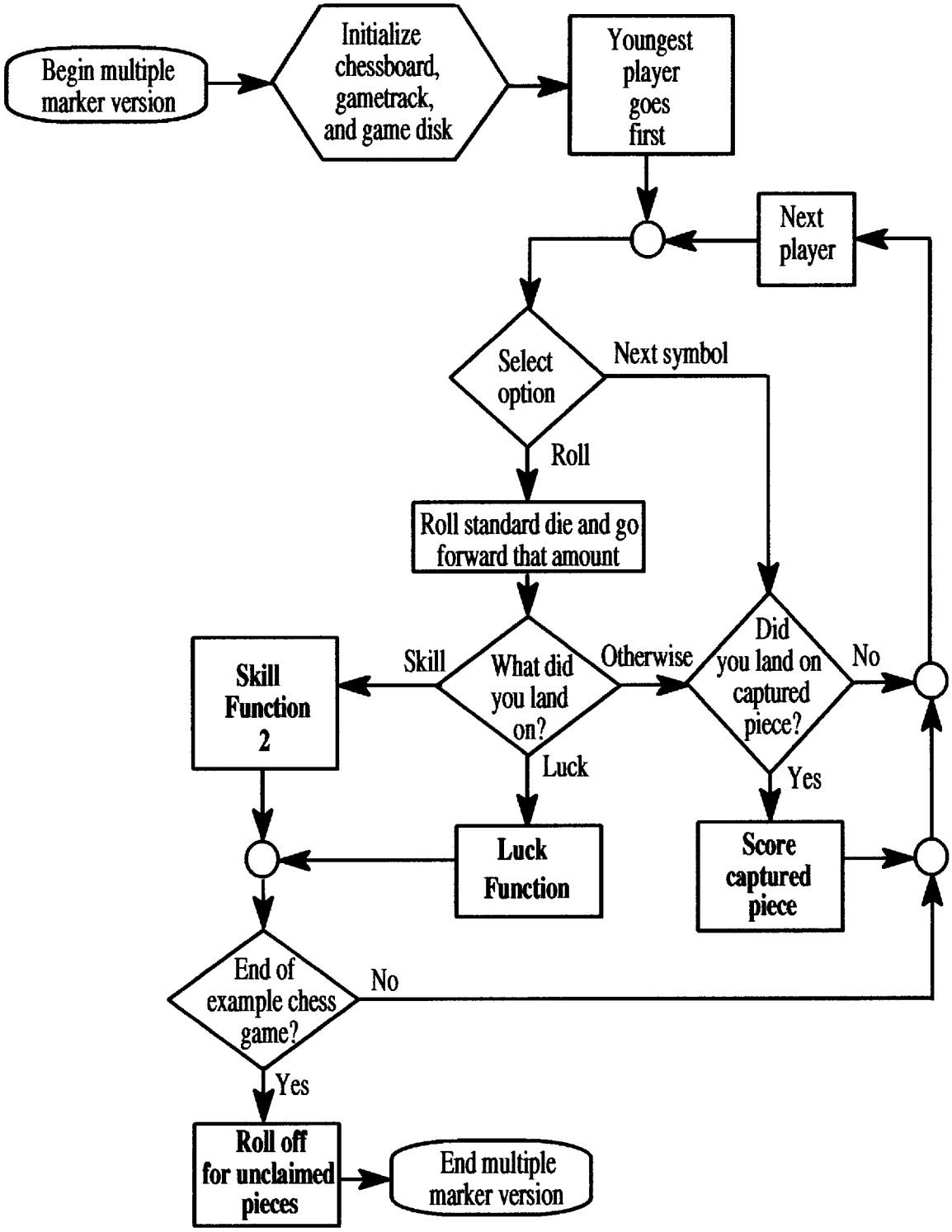

FIG. 7*a* is a flowchart depicting the operation of yet another embodiment or playing level of the present invention.

Figure 7B:
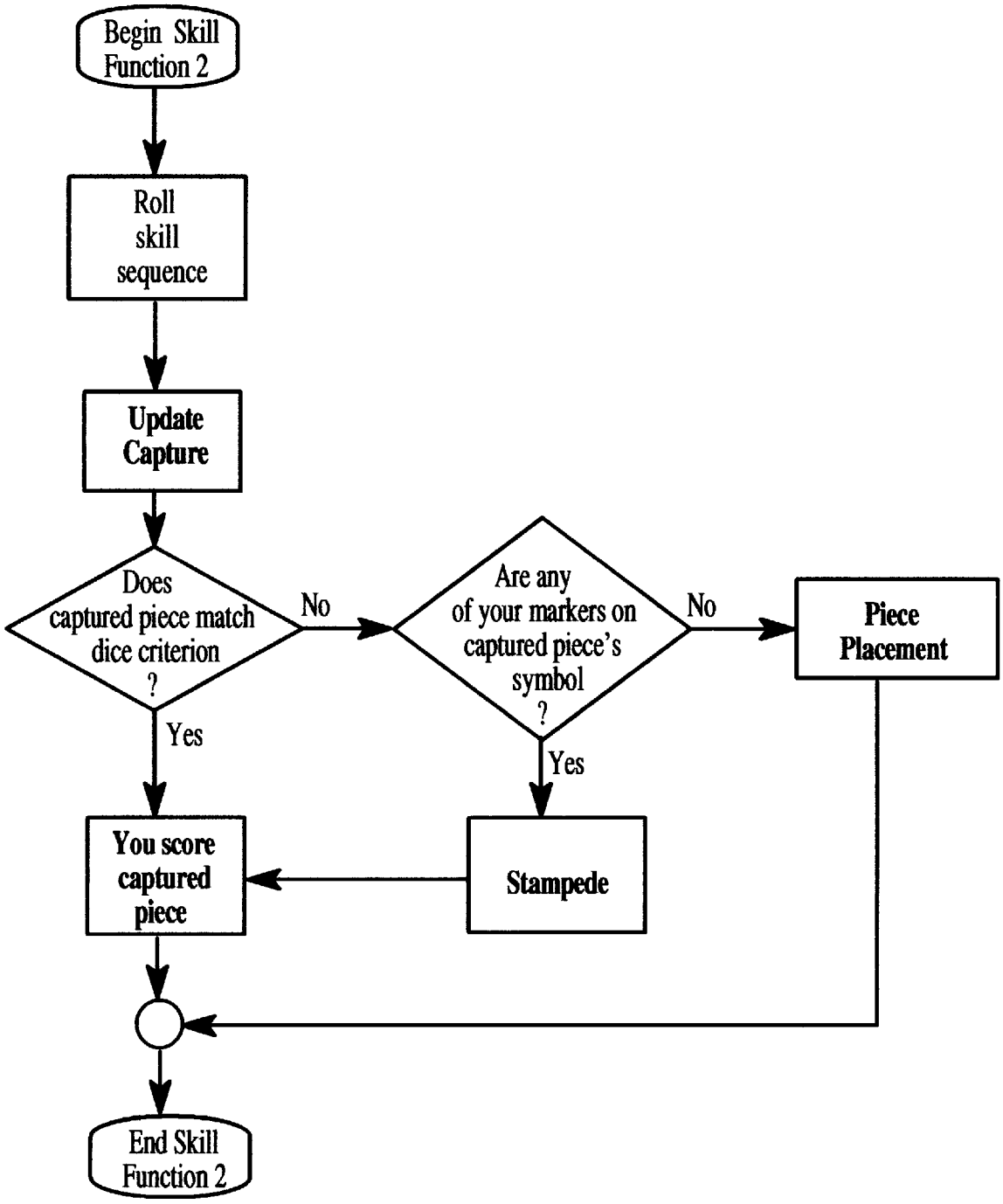

FIG. 7*b* is a flowchart depicting rule logic referred to in FIG. 7*a*.

Figure 7C:
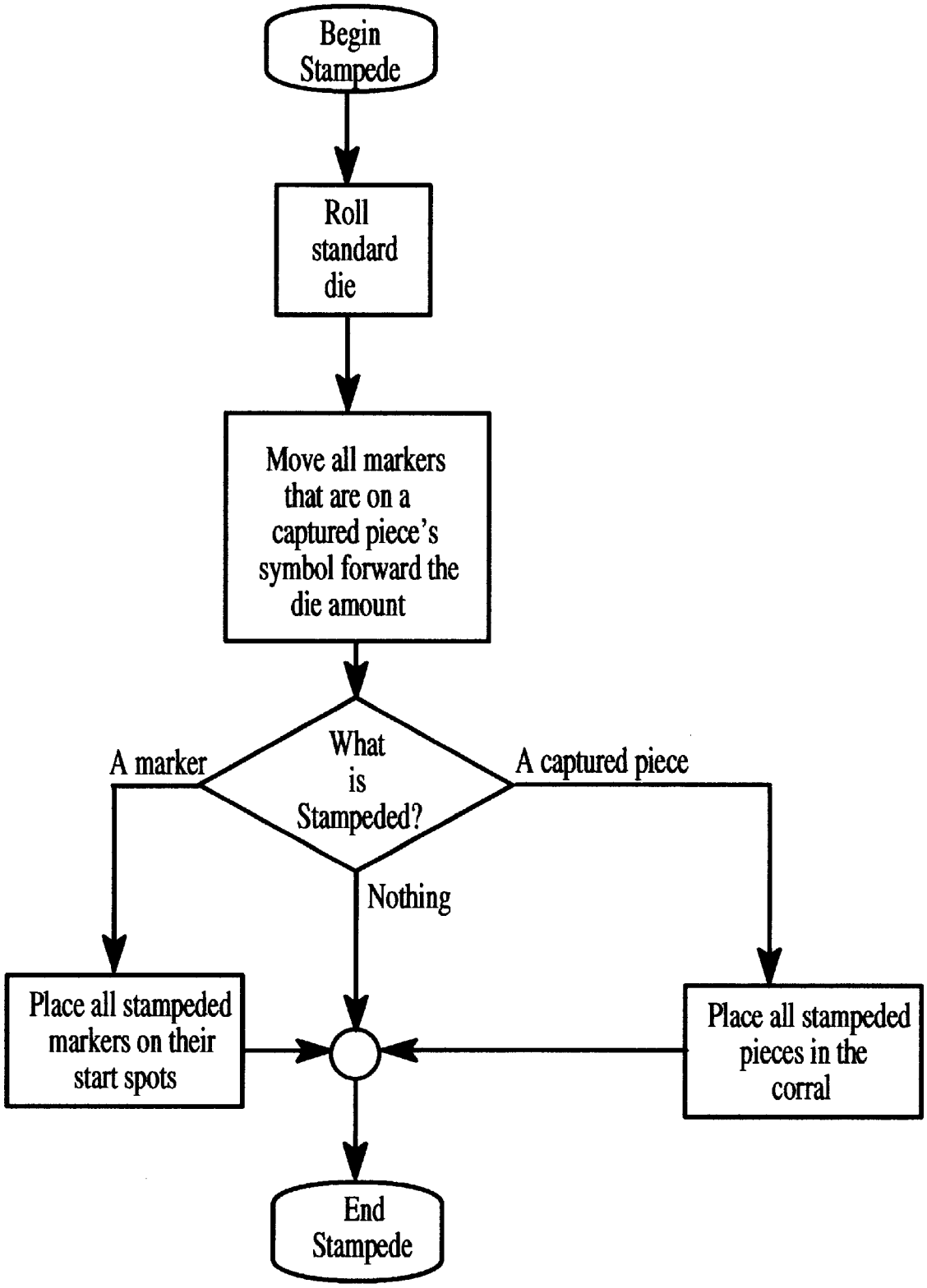
Figure 7D:
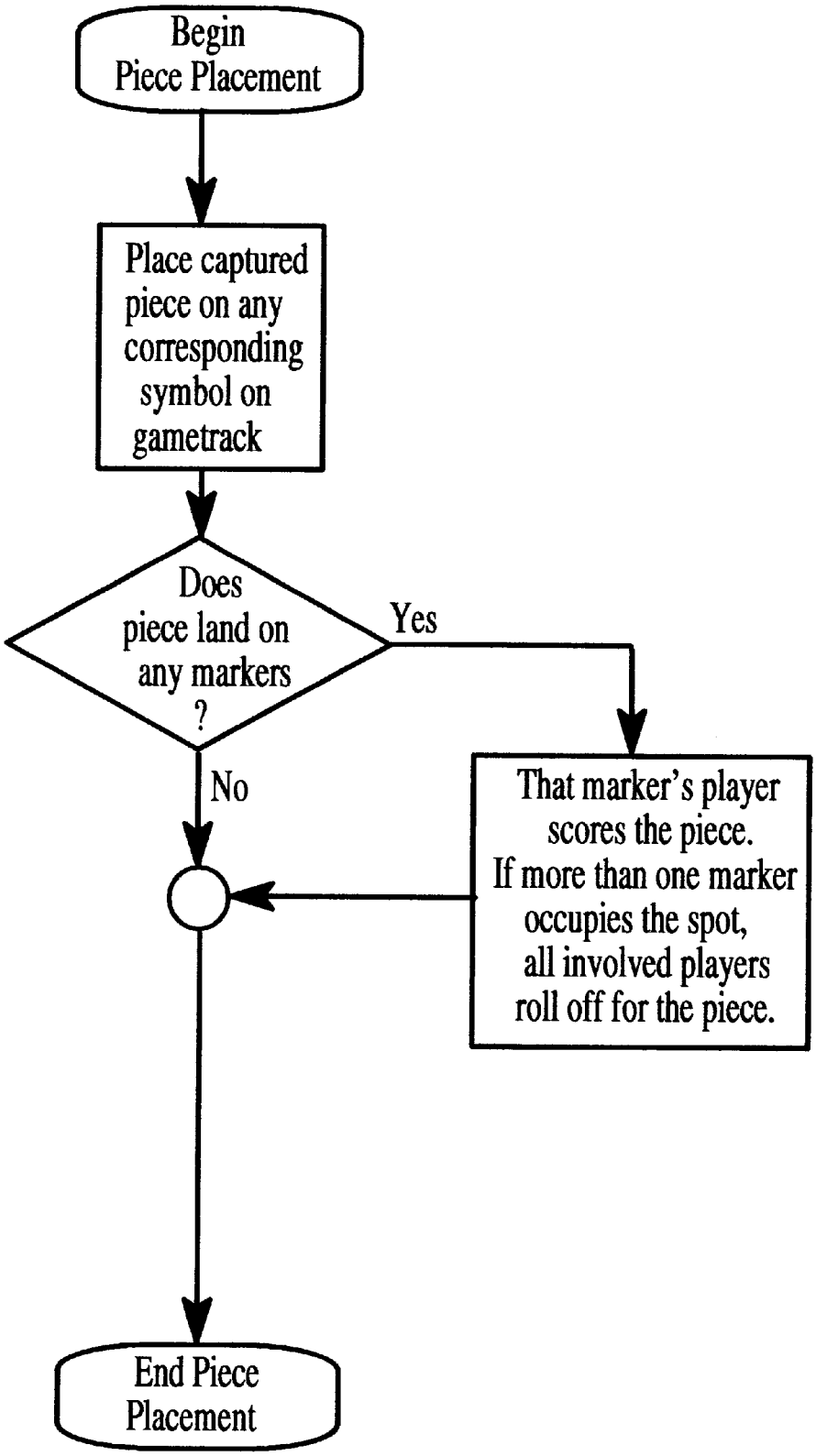

FIGS. 7*c* and 7*d* are flowcharts depicting rule logic referred to in FIG. 7*b*.

Figure 8:
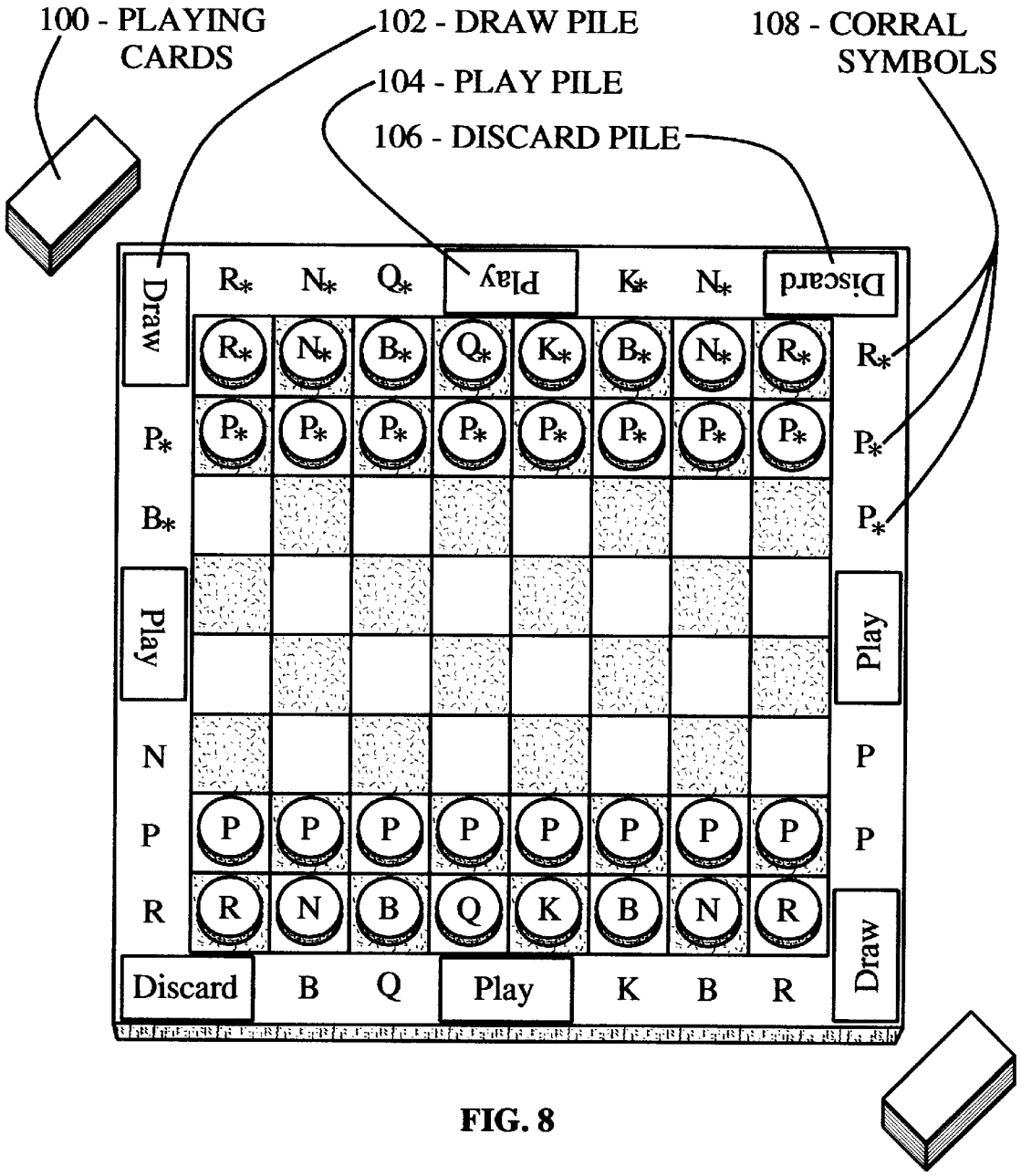

FIG. 8 is a view of the playing surface of another major embodiment of the present invention, illustrating a game board wherein the utilization of playing cards determines the outcome of each game. Also illustrated is a set of chess pieces in their initial positions.

Figure 9:
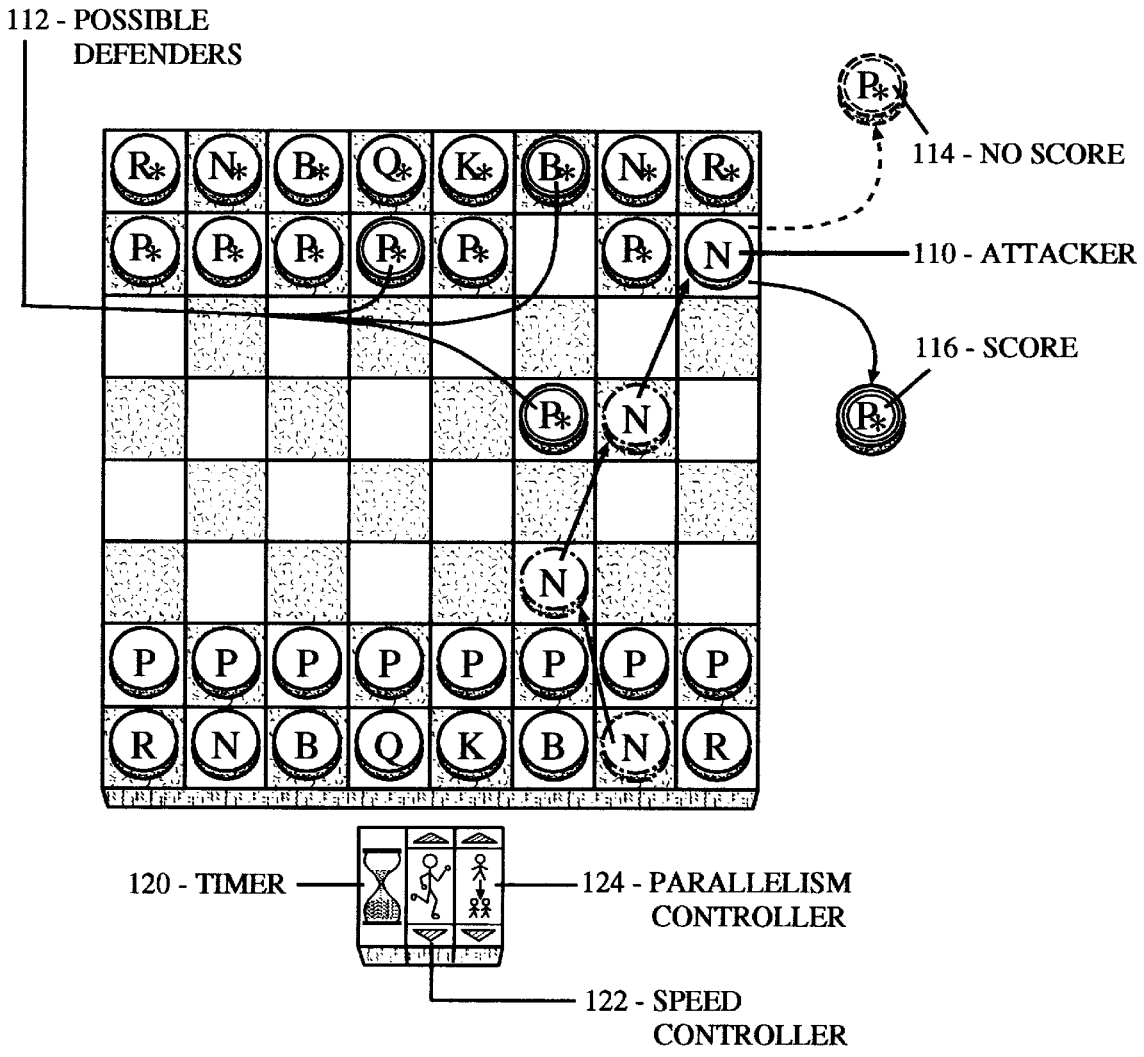

FIG. 9 is a view of a unique software embodiment of the present invention, illustrating automatically driven example chess movements and a scoring means for enticing players to quickly locate possible chess movements.

In the figures and their discussion, the following abbreviations will be used to designate the well-known chess pieces:

| | |
|---|---|
| K-LIGHT KING | K*-DARK KING |
| Q-LIGHT QUEEN | Q*-DARK QUEEN |
| R-LIGHT ROOK | R*-DARK ROOK |
| B-LIGHT BISHOP | B*-DARK BISHOP |
| N-LIGHT KNIGHT | N*-DARK KNIGHT |
| P-LIGHT PAWN | P*-DARK PAWN |

List of Reference Numerals

| | |
|---|---|
| 10 | game board |
| 12 | playing marker |
| 14 | chess die |
| 16 | standard die |
| 20 | chess board |
| 22 | chess region |
| 24 | region index |
| 26 | square index |
| 30 | game track |
| 32 | start spots |
| 34 | chess symbol spot |
| 36 | luck function spot |
| 38 | skill function spot |
| 40 | corral |
| 50 | game disk |
| 52 | disk hole |
| 54 | side one |
| 56 | side two |
| 60 | move sector |
| 62 | move element |
| 64a | old region index |
| 64b | old square index |
| 64c | new region index |
| 64d | new square index |
| 64e | capture indicator |
| 70 | disk holder |
| 72 | male snap |
| 74 | female snap |
| 76 | front base |
| 78 | rear base |
| 80 | holder arm |
| 82 | sector viewport |
| 90 | move highlighter |
| 92 | arm hooks |
| 94 | move viewpoint |
| 96 | finger grip |
| 100 | playing cards |
| 102 | draw pile |
| 104 | play pile |
| 106 | discard pile |
| 108 | corral symbols |
| 110 | attacker |
| 112 | possible defenders |
| 114 | no score |
| 116 | score |
| 120 | timer |
| 122 | speed controller |
| 124 | parallelism controller |

SUMMARY

In accordance with the present invention, our chess-like game comprises a gameboard containing a chess board representation, chess pieces that move on the chess board, example chess games that are used to drive the movements of the chess pieces on the chess board, and a set of scoring pieces consisting of captured chess pieces resulting from the example chess games. Players are assigned a random prediction regarding which type of chess piece will be captured next according to the current example, and they are more likely to score a captured piece if the corresponding random prediction is accurate. In a software embodiment of the present invention, players race against the clock to score as many captured chess pieces as possible in the allotted time.

DESCRIPTION —MAIN EMBODIMENT

Figure 1:
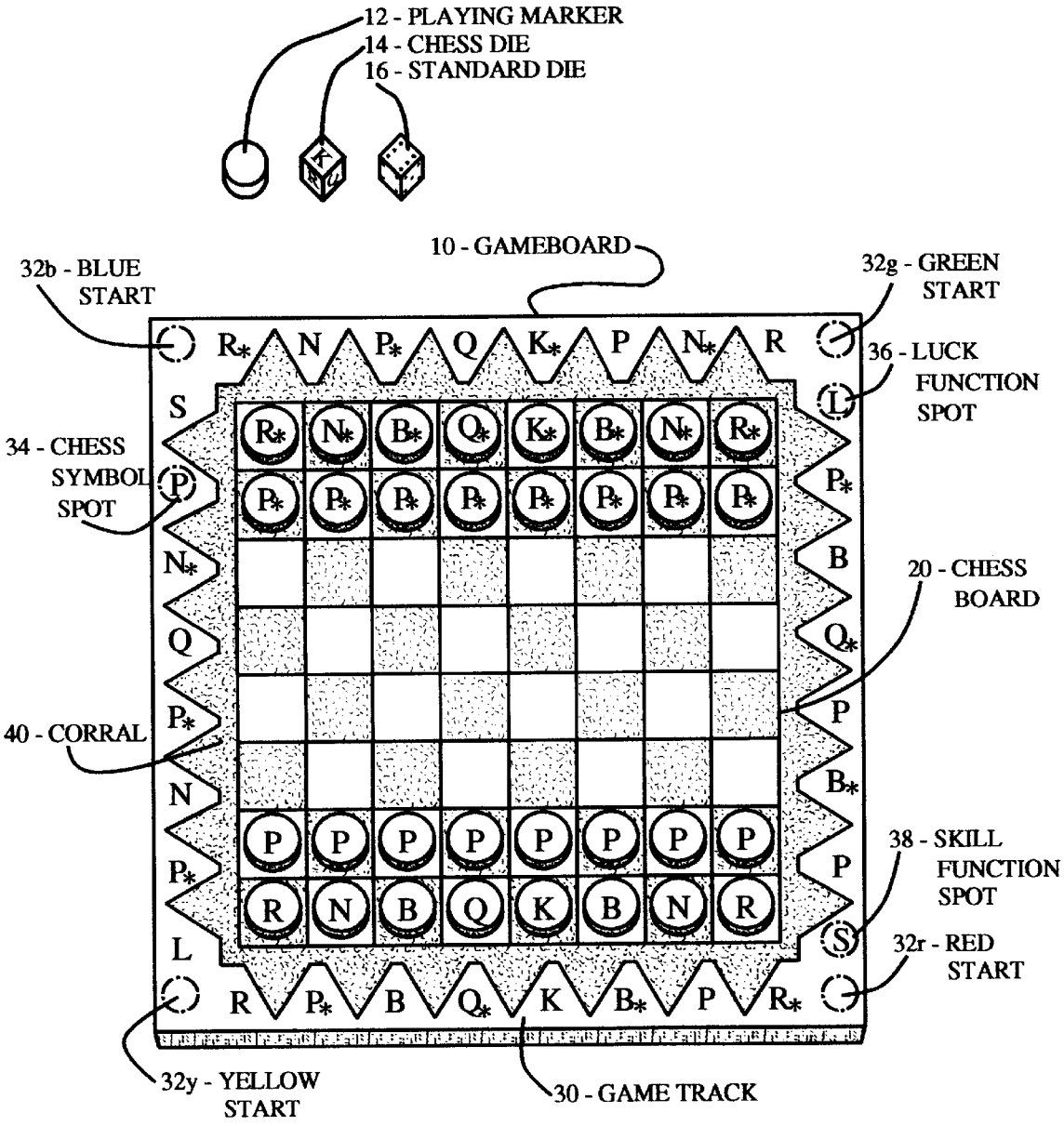
FIG. 1 is a view of the playing surface of one major embodiment of the present invention, illustrating a game board wherein designations representing chess pieces have been included on the perimeter thereof, the designations capable of occupation by a set of playing markers. Also illustrated is a set of chess pieces in their initial positions.

A typical embodiment of the game board of the present invention is illustrated in FIG. 1 (top view). The game board 10 is thin and flat, preferably constructed with a foldable cardboard-like material. Printed on the surface of the game board 10 is a central checkerboard, or chess board 20 and a game track 30 along the perimeter of the game board 10. The chess board 20 bounds the area of example chess play for two sets of chess pieces, one light-colored, the other dark.

The game track 30 primarily bounds the area of play for four sets of playing markers 12, preferably colored red, green, blue, and yellow. The track 30 is comprised of a multitude of spaces for marker 12 occupation, each space marked with a special designation. Four classes of designation are demonstrated in FIG. 1 through the use of dot-dashed circles around example sites for each class. The classes of designation include start spots 32 for the playing markers, a luck-function spot 36, a skill-function spot 38, and a chess symbol spot 34. The positioning of the playing markers 12 on these spots function as a controller for the placement of captured chess pieces that result from example movements of the chess pieces on the chess board 20. During play, players have no control over which chess piece is going to be moved or where the uncaptured piece will be placed on the chess board. Players do, however, have the ability to make a prediction regarding which piece or type of piece will be captured next according to the current example. An improved prediction accuracy as an objective, a simple and fun means for making the prediction, and the use of these captured chess pieces as scoring elements is essentially what this embodiment of the present invention is all about.

In the particular embodiment shown in FIG. 1, the game track is comprised of four start spots 32, two luck-function spots 36 (represented by an "L" for luck), two skill-function spots 38 (represented by an "S" for skill), and twenty-eight chess symbol spots 34. A corral 40, which is also capable of marker occupation, functions as a temporary storage area for some captured chess pieces.

Also, the element of chance is introduced through the use of a standard die 16 and a chess die 14 which has designations resembling the types of chess pieces being used. At the simplest level of play, the standard die 16 drives the markers 12 around the game track 30. The positioning of the markers on the track may in some cases initiate a predetermined sequence of example chess moves on the chess board 20 until a chess piece is captured. The placement of this piece with respect to the gameboard may in some cases indicate that a player has claimed or scored that piece. The player having the most scored pieces at the end of the game wins. The rolling of standard dice 16 and chess dice 14 determines who scores what piece.

Figure 2:
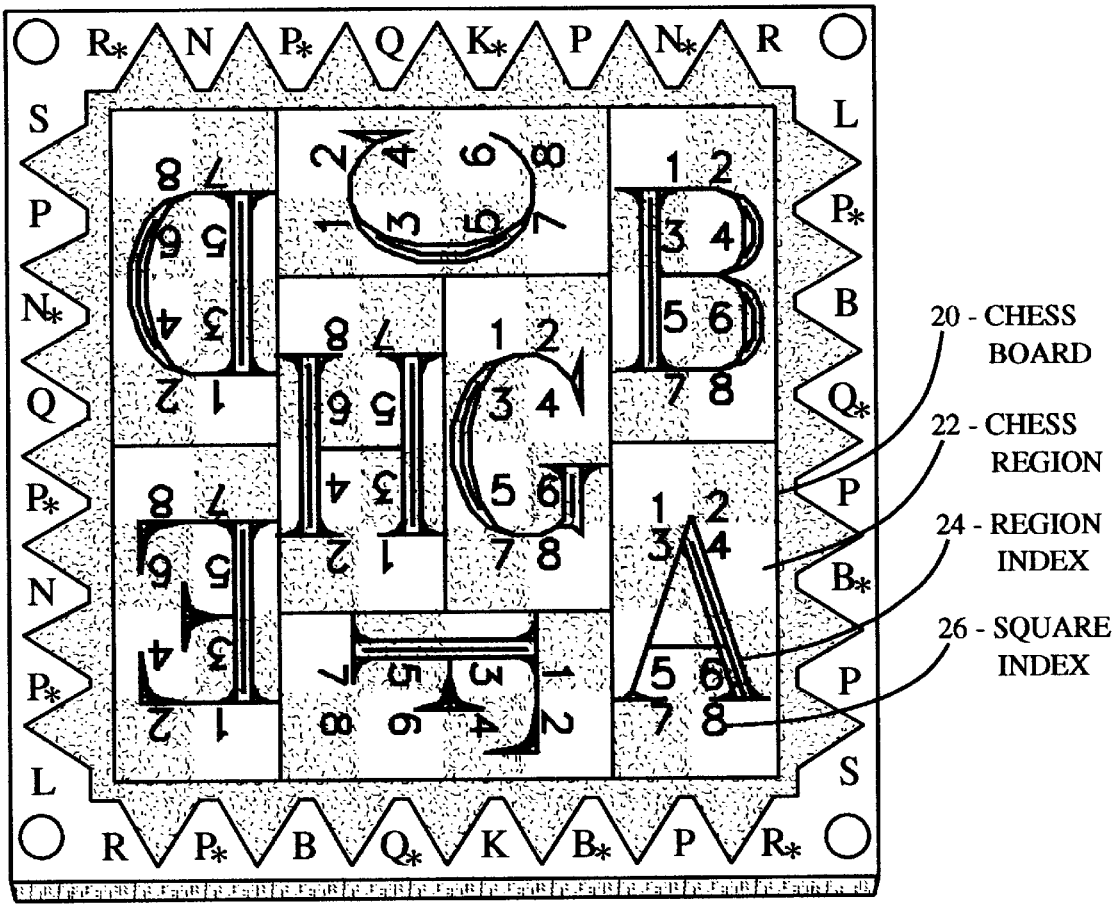
FIG. 2 is a view of the playing surface in FIG. 1 including an efficient chess board indexing system.

Please refer now to FIG. 2. This figure shows the same playing surface and embodiment as that shown in FIG. 1, with the exception that the chess board 20 in FIG. 2 is marked with a visually-efficient indexing system. This was not shown in FIG. 1 for purposes of clarity. The idea here is to mark a region of squares with a regional alphanumeric character and an individual square or element with an elemental alphanumeric character so that a region can be found quickly and an individual square within the region follows soon thereafter.

In the embodiment shown, the chess board 20 consists of eight chess regions 22. Each chess region 22 is designated by a region index 24. Each square within the bounds of a chess region 22 is itself designated by a square index 26. Therefore, any square on the chess board 20 may be referenced by a two-character string consisting of a region index 24 and the region's square index 26. The squares on the corners of the chess board 20, for example, can be located from the two-character reference strings "A8", "B2", "D8", and "E2".

Figure 3:
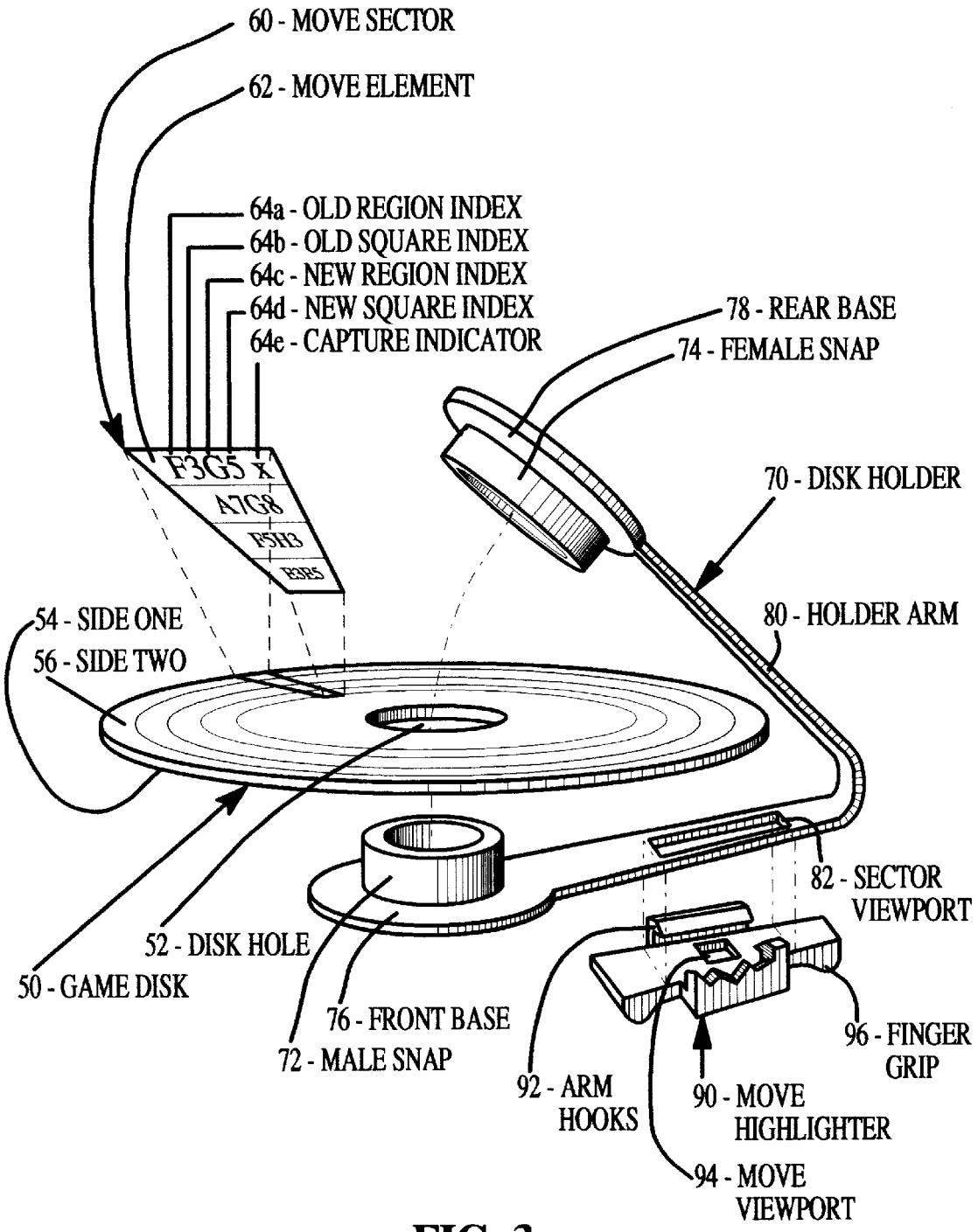
FIG. 3 is a perspective view of a rotary device, wherein a multitude of indicia represented in FIG. 2 have been placed in a circular fashion around the rotary element.

Please refer now to FIG. 3. This figure is a perspective view of a rotary device, where a multitude of indicia represented in FIG. 2 have been placed in a circular fashion around the rotary element. More specifically, a cardboard-like game disk 50 contains printed information that represents multiple example chess games. The format for storing this information on the game disk 50 is consistent with the indexing system represented in FIG. 2.

Any chess game can be reduced down to a sequence of move elements 62 where each element 62 represents the act of a player grabbing a piece on a source square and placing it on a destination square. If a chess piece was on the destination square before the move element 62 began, then that piece is captured and placed off the chess board. Even castling and en passant can be reduced down to this format by using two moves elements 62 to contain the information instead of one move using standard notation. Therefore, this is one reason why we have determined that using a sequence of move elements 62 instead of standard notation is one of the easiest-to-understand means for recording the tangible or non-software version of our game.

Please continue to refer to FIG. 3. Each move element 62 on the game disk 50 is comprised of a source square index, a destination square index, and a capture indicator 64*e*. Each source square index is represented by an old region index 64*a* and an old square index 64*b*. Each destination square index is represented by a new region index 64*c* and a new square index 64*d*. The capture indicator 64*e* indicates whether or not a chess piece was captured during the current move element 62.

Consecutive moves from the current example chess game are represented by adjacent move elements 62 that are radially aligned from the axis of rotation of the game disk 50 to form a ring for each game. If more space is required for the ring-like representation of a chess game to fit on side one 54 of the game disk 50, then a continuation of the chess game may be represented on side two 56 in a ring-like fashion having a game ring diameter equal to the game ring diameter on side one 54. Preferably, four chess games are represented on each game disk 50, each highlighted with a ring having a color chosen from the following set: red, green, blue, and yellow.

Before each game of play using the present invention, the game disk 50 may be fastened to a disk holder 70 so that the game disk 50 may be rotated in a consistent direction that proceeds to highlight the move elements 62 that correspond to a sequential representation of the chosen example chess game. The fastening process involves connecting a male snap 72 to a female snap 74 so that a disk hole 52 is filled by one or both of the snaps. Depending on the physical dimensions of the snaps relative to the disk hole 52, the game disk 50 may be further secured by contact surfaces with a front base 76 and the female snap 74, or by contact surfaces with the front base 76 and a rear base 78. The disk holder 70 acts as a simple rotational conductor for the game disk 50.

Both ends of the disk holder 70 are connected by a holder arm 80. The flexibility of the holder arm 80 during disk fastening may be ensured through the possible use of flex points on the outer limits of the holder arm 80. The placement of the flex points on the outer side of the disk holder 70 would prevent overextension of the holder arm 80 so that the device may experience less fatigue. However, the extension of the arm in FIG. 3 is exaggerated, so the use of flex points may be unnecessary, especially if the disk holder 70 is constructed with a soft material.

A move highlighter 90 can be snapped onto the holder arm 80 and held into place with arm hooks 92. The move highlighter 90 may then be easily translated along the holder arm 80 through manual use of finger grips 96. Plastic is probably the most efficient candidate for the construction material to be used for the disk holder 70 and the move highlighter 90.

Viewing the highlighted move element 62 involves placing the fully-connected rotary device in FIG. 3 on its rear base 78 and observing the information contained in the highlighted move element 62 through a move viewport 94 cut out of the move highlighter 90. A sector viewport 82 cut out of the disk holder 70 highlights the current move sector 60, and the radial position of the move highlighter 90 further constrains the highlighted view to a move element 62.

Therefore, a collection of example chess games is chosen by the selected game disk 50; the radial position of the move highlighter 90 selects the current example chess game; and the angular position of the game disk 50 relative to the holder arm 80 selects the current move element 62. By a simple rotation of the game disk 50 and a possible flip of the disk over to side two 56, a complete example chess game can be recalled in a very simple and efficient manner.

Figure 4:
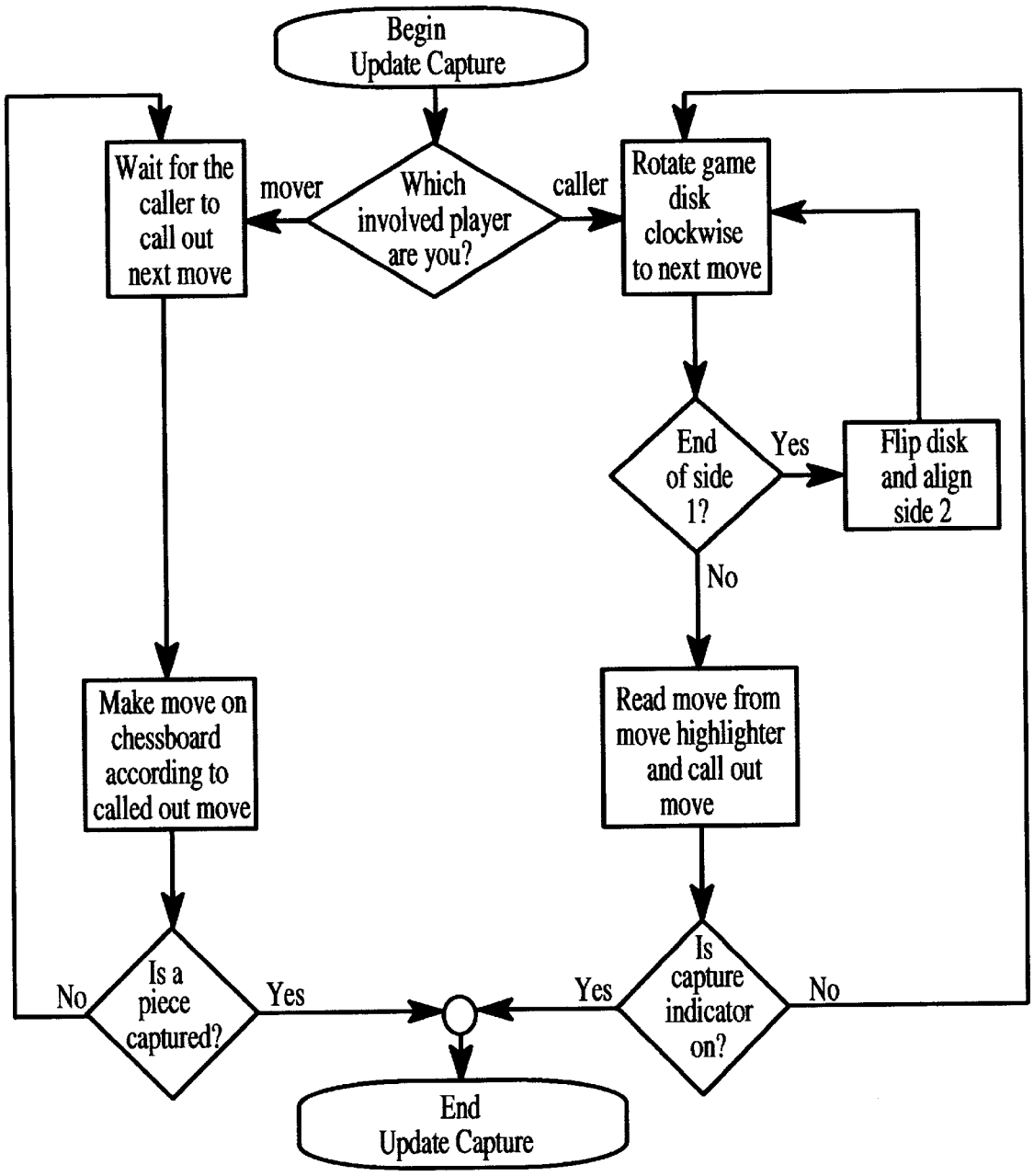
FIG. 4 is a flowchart depicting the operation of the device shown in FIG. 3.

Please refer now to FIG. 4. The figure is a flowchart depicting the operation of the rotary device shown in FIG. 3. In our attempts to discover the optimal means of recalling and updating an example chess game, we found that viewing the current move element 62 and making the corresponding move on the chess board 20 is a task best suited for two players: a "caller", and a "mover". The caller views the current move element 62 and calls out the reference string printed on it. The mover listens for the caller's next move and then makes the corresponding move on the chess board 20 using a chess piece. In this way, the mover doesn't have to take his/her eye from the chess board 20.

The "Update Capture" process as described in FIG. 4 is referenced throughout the inter-connected rule logic of the tangible embodiments of the present invention as shown in FIGS. 5*a* through 7*d*. At the end of this process, the mover has in his/her hand a captured chess piece resulting from the chosen example chess game, the placement of which gives players incentive to pay attention to the examples. Unlike conventional chess or any other chess-like game, the present invention utilizes the placement of these captured piece in a way that is designed for teaching children how to play chess. That is, they are used as scoring pieces. The idea is that if all of the chess pieces on the chess board are potential scoring opportunities, then players will be interested in and pay close attention to the examples represented in the example chess games.

In FIGS. 5*a* through 7*d*, a shaded box represents a game situation where there is a possibility of scoring a captured piece. Because the outcome of our game is determined by the player who scores the most captured chess pieces, all scoring processes defined by the shaded boxes may result in a player either gaining or losing chess pieces. Due to this, each player becomes curious as to which chess piece is going to be taken next. This curiosity combined with conditioning from repetitive play provides a very effective means for improving insight as to which chess piece will be captured next. This improvement in insight inherently requires an improvement in knowledge about the playing rules behind the game of chess.

We have determined through extensive testing of rule variations that it may be desirable to provide a dynamic set of playing rules which utilizes additional degrees of freedom as the skill levels of the players increase. This can be achieved through a multi-level set of playing rules which uses the game apparatus of this embodiment in increasingly difficult ways. With this dynamic set of playing rules, the beginning level of play can effectively teach inexperienced players how to play chess with a minimal amount of learning overhead (from learning the beginning set of playing rules). The more skillful levels of play can provide more options (and thus a little more learning overhead) so that skillful players can use their knowledge of chess to their advantage.

Therefore, the dynamic set of playing rules can add degrees of freedom for the knowledgeable group of chess players and subtract them for the novice. By gradually introducing new options as a player's skill level improves, the dynamic set of game rules can be well-suited for a player up to a Grandmaster level. This set is contained within multiple levels of play which may represent multi-tiered minor embodiments of this major embodiment of the present invention.

As stated above, the tangible or non-software embodiments of the present invention, however, do not allow any control over how uncaptured chess pieces move during the play back or recall of an example chess game. In this way, the present invention has a built-in capacity for a very small number of degrees of freedom. FIGS. 5*a* and 5*b* represent a primary level of play of this major embodiment of our game where players each control only a single playing marker 12 and have only a single option in all situations. The outcome of each game at this level is completely determined by luck.

FIGS. 6*a* through 6*c* represent a higher level of play of this major embodiment of our game where players control only a single playing marker 12 but have a variety of options. The outcome of each game at this level is determined by a combination of luck and skill.

FIGS. 7*a* through 7*d* represent an even more complex level of play of this major embodiment of our game where players control multiple playing markers 12 and have a variety of options. The outcome of each game at this level is also determined by a combination of luck and skill.

An obvious level beyond the levels mentioned involves the play of chess using the playing surface shown in FIG. 1. At this point, the mission was a success and players now have the ability to play chess autonomously. A chess board and chess pieces are readily available for chess play. Of course, the outcome of each game at this level is determined completely by skill, and all of the degrees of freedom inherent to chess have been restored.

Due to the extensive range of possible rule variations using the same utility of the present invention, the levels of play depicted in FIGS. 5*a* through 7*d* are only examples. Levels of play may be set at any point in between the examples shown and the number of levels may be altered. Obvious rule variations derived from the minor embodiments shown are also possible.

The essence of the present invention remains the same regardless of small rule variations. The initial level of play requires very little skill due to the minimal number of degrees of freedom required to recall an example chess game, and the outcome of each game (who scores the most resulting captured chess pieces) is based mostly on luck. The final level of play (chess) requires a complete knowledge of the rules of chess and the outcome of each game is based completely on skill.

The potential range in rule complexity of this major embodiment of the present invention can be seen by a comparison between FIG. 5*a,* FIG. 6*a,* and FIG. 7*a*. FIG. 6*a* and FIG. 7*a* can reduce to FIG. 5*a* by eliminating degrees of freedom.

OPERATION—MAIN EMBODIMENT

Please refer to FIG. 4. This flowchart, labeled "Update Capture" shows how to recall an example chess game from an arbitrary point until a chess piece is captured. The player whose turn it is may under certain game situations be the "mover". When a player is assigned this title, the player to the right of the mover becomes the "caller".

The caller's responsibility is to rotate the game disk 50 (FIG. 3) clockwise until the next move element 62 appears in the move viewport 94. The caller then reads the reference string printed on the move element and calls it out as it would be read aloud. If the capture indicator 64*e* displays an "X", a chess piece will be captured during that move and the caller has completed his/her task. Otherwise, the caller continues to rotate the disk and call out the highlighted move. If the end of side one 54 is reached, the caller must then disconnect the male snap 72 from the female snap 74, remove the game disk 50, flip the disk over, reconnect the disk to the disk holder, and align the disk to the beginning of side two 56.

The mover's responsibility is to wait for the caller to call out the next move and then make the corresponding example move on the chess board 20. The first two characters called out locate the chess piece to grab and the last two characters called out locate where the grabbed piece should be placed. The mover continues until the grabbed piece lands on another chess piece, which corresponds to when the caller's indicator displays an "X". The mover then has to place this captured chess piece either in the corral 40 (FIG. 1), on the game track 30, or directly in front of him/her thereby scoring the piece. This choice of placement depends on the level of play and the game situation.

Primary Level of Play

Please refer now to FIG. 5*a*. This figure depicts level one play. Before play can begin, the chess board, game track, and game disk must be initialized. Chess board initialization includes placing all 32 chess pieces in their initial positions as shown in FIG. 1. Game track initialization includes placing each player's marker at the start spot 32 that matches the marker's color. Game disk initialization includes selecting a game disk 50 (FIG. 3) from a collection of disks that are part of the tangible embodiments of the present invention and facing side one toward the front base 76; placing the disk so that the male snap 72 of the disk holder 70 slides through the disk hole 52; connecting the male snap 72 to the female snap 74 so that the game disk 50 is held firmly in place by contact surfaces with the disk holder 70; and aligning the disk so that the first move element 62 of the selected game is viewed through the move viewport 94.

After game initialization, the next step of this level of play is selecting the player who will begin game play. A simple choice is to let the youngest player go first. Player rotation after this should be in a consistent direction around the game board.

Each player's turn is comprised of the following:

Select an option. Since this level is designed to have a minimal number of degrees of freedom, there is only one option here: to roll.

The player rolls a standard die and moves his/her marker ahead that amount.

If the marker didn't land on a luck function spot 36, the player's turn is over. Otherwise, he/she must rely on luck to score a chess piece through the use of a luck function. The logic behind the luck function is depicted in FIG. 5*b* and is explained below.

Repeated use of the luck function (which contains an "Update Capture" process) eventually completes the recall of the example chess game as stored on the game disk. When the example chess game is over, all players simultaneously "roll off" for all chess pieces in the corral (to roll off means to keep rolling until a player decisively has the highest roll). In this way, all players continue to have interest in the game regardless of how far behind they are. This is so because a large change in score (determined by the number of chess pieces a player has in front of him/her) can still occur in a small amount of time at the end of the game.

Please refer now to FIG. 5*b*. This flowchart depicts the luck function process that occurs when a player lands on a luck function spot 36 (FIG. 1). First, the player rolls multiple chess dice 14 at once. The roll sequence here includes only one roll of multiple chess dice. Next, the "Update Capture" process as described in FIG. 4 is played out until the player who landed on the luck function spot 36 (the "mover") has a captured chess piece in hand. If the captured piece matches any of the designations from the rolled chess dice, the player scores the piece. Otherwise, it is placed in the corral 40 until the roll-off at the end of the game.

The overall function of this level of play is to condition the novice to make legal chess moves through example while providing a fun and interesting means for doing so without any prior knowledge of the game of chess. Each player who lands on a luck function spot 36 (FIG. 1) consequently has an active interest regarding which piece will be moved off the chess board next because if the captured piece matches any of the designations on the rolled chess dice 14, the player scores. The winner of the game here is completely determined by luck.

Secondary Level of Play: Version 1

Please refer now to FIG. 6*a*. This figure depicts a version of level two play. FIG. 6*a* is identical to FIG. 5*a* up to the "Select option" condition and after the "End of example chess game?" decision. Here, the player has more options (degrees of freedom) than in level one. At this point, it is assumed that all players have played level one enough to be proficient with the skeletal framework of our game. Therefore, more options can now be introduced to allow players to use what they have learned (deduced through example) about chess to their advantage.

Each player's turn in level two here is comprised of the following:

Select an option. Here the player may have up to three options: "Roll", "Guess Capture", or "Next symbol".

The rolling option is the same as that in level one. The player rolls a standard die and moves his/her marker ahead that amount. If the marker lands on a luck function spot 36 (FIG. 1), he/she must rely on luck to score a chess piece through the use of the luck function as depicted in FIG. 5*b*. If the marker lands on a skill function spot 38, the player may use his/her chess aptitude to score a chess piece through the use of a "Skill Function 1" process. The logic behind the "Skill Function 1" process is depicted in FIG. 6*b* and is explained below.

A "Guess Capture" option allows the player to directly guess the exact type of chess piece that will be captured next. However, the guess is constrained to the chess symbol assigned by the marker's current position. Therefore, the player's marker must be located on a chess symbol spot 34 for this option to be invoked. In addition, the player must have previously scored at least one chess piece for this option to be invoked. The reasoning for this will become clear after FIG. 6*c* is described.

The last option allows the player to move his/her marker to the next symbol that is identical to the one underneath the marker's current position. This option may only be invoked if the player's marker is currently located on a chess symbol spot 34.

During some game situations, as described below, a captured chess piece is placed on one of its corresponding chess symbols on the game track 30 instead of in the corral 40. Due to this potential placement, if a player's marker lands on a spot on the game track that is occupied by a chess piece, the player scores the piece.

Please refer now to FIG. 6*b*. This flowchart depicts the "Skill Function 1" process that occurs when a player lands on a skill function spot 38 (FIG. 1). The structure of the logic here is very similar to that of the "Luck Function" process shown in FIG. 5*b*. The differences are how the chess dice 14 are rolled and where the captured piece is placed if the piece doesn't match any of the designations on the rolled chess dice 14.

The "Roll skill sequence" involves first rolling one or multiple chess dice 14 at once. The player may then decide to roll again up to a predetermined number of times. Also, the player may continue rolling some dice and not others. An "Update Capture" process then ensues, and if the resulting captured piece matches any of the final chess dice designations, the player scores the piece. Throughout a skill-based rolling sequence, the player is given options (degrees of freedom) which may be used to increase scoring probability for the skillful chess player.

If the captured piece doesn't match any of the rolled chess dice, the piece is placed on the game track 30 (FIG. 1) instead of in the corral 40. The placement is constrained to a spot with a chess symbol 34 that exactly matches the piece type. Furthermore, if that piece is placed on a spot that another player's marker currently occupies, then that player scores the piece. A simple variation to the "Skill Function 1" process is to simply place the captured piece in the corral 40 if the roll was unsuccessful as shown in FIG. 5*b*.

Please refer now to FIG. 6*c*. This figure depicts the logic behind the "Guess Capture" option. As stated above, this option allows the player to directly guess the exact type of chess piece that will be captured next, and this guess is constrained to the chess symbol assigned by the marker's current position. An "Update Capture" process is played out until a chess piece is captured. If this captured piece exactly matches the guess, then the player scores the piece. If it doesn't match the guess however, the player is penalized by requiring him/her to place the captured piece along with one of his/her previously scored chess pieces in the corral 40. In order to invoke this option, the player must already have something to lose: a scored chess piece.

Secondary Level of Play: Version 2

Please refer now to FIG. 7*a*. This figure depicts another possible version of level two play. FIG. 7*a* is identical to FIG. 5*a* and FIG. 6*a* up to the "Select option" condition and after the "End of example chess game?" decision. Here, the player has more options (degrees of freedom) than in the primary level and more markers than in the single-marker version of level two. At this point, it is assumed that all players have played through the primary level of play and possibly through a more complex single-marker version enough to be proficient with single-marker play.

Each player's turn in level two here is comprised of the following:

Select an option. Here the player may have up to two options: "Roll", or "Next symbol".

The rolling option is essentially the same as that in the primary level. The player rolls a standard die and moves any of his/her markers ahead that amount. If the moved marker lands on a luck function spot 36 (FIG. 1), he/she must rely on luck to score a chess piece through the use of the luck function as depicted in FIG. 5*b*. If the marker lands on a skill function spot 38, the player may use his/her chess aptitude to hopefully score a chess piece through the use of a "Skill Function 2" process. The logic behind the "Skill Function 2" process is depicted in FIG. 7*b* and is explained below.

The other option allows the player to move his/her marker to the next symbol that is identical to the one underneath the marker's current position. This option may only be invoked if the player's marker is currently located on a chess symbol spot 34. Also, this option is identical to the corresponding option in the last version of level two.

If a player's marker lands on a spot on the game track that is occupied by a chess piece, the player scores the piece.

Please refer now to FIG. 7*b*. This flowchart depicts the "Skill Function 2" process that occurs when a player lands on a skill function spot 38 in this version of play. The structure of the logic here is very similar to that of the "Skill Function 1" process shown in FIG. 6*b*. The difference is encountered if the captured piece doesn't match any of the final chess designations on the rolled chess dice 14 from the "Roll skill sequence" process described above. If this occurs, the player has failed to score using the chess dice.

However, the player still has an alternative means of scoring here. Since this version of play involves multiple markers, the player may have skillfully placed one of his/her other markers on a matching chess symbol 34 during a previous turn. To reward this insight, the player still scores the captured chess piece. This alternative means for scoring is a higher-level skill-based means for partially controlling a lower-level randomizing means (rolling standard dice). In addition, all markers that are on a matching chess symbol spot 34 (FIG. 1) become part of a "Stampede", which is depicted in FIG. 7*c* and described below. If none of the current player's markers are on a chess symbol spot 34 that match the captured piece, then the piece must be placed according to the "Piece Placement" process, which is depicted in FIG. 7*d* and described below.

Please refer now to FIG. 7*c*. This flowchart depicts the "Stampede" process, which may occur as part of the "Skill Function 2" process. This process requires the current player to roll a standard die 16. The amount rolled is the length of the "Stampede". All markers that are on a chess symbol spot 34 (FIG. 1) that matches the current captured piece become part of the "Stampede" and thus each move ahead the rolled amount. If a captured chess piece is stampeded, then it is placed in the corral 40. If a marker is stampeded, it is placed back to its corresponding start spot 32 and turned upside down until that marker's player rolls a six. In this way, every player who may have correctly predicted the next captured piece is rewarded and every player who may not have suffers a small setback.

Please refer now to FIG. 7*d*. This flowchart depicts the "Piece Placement" process, which may occur as part of the "Skill Function 2" process. This process requires the current player to place the captured piece on any corresponding symbol on the game track. If any player's marker is already on that symbol, then that player scores the piece. If more than one marker occupies the spot, all players who have markers on the spot roll off for the piece.

DESCRIPTION AND OPERATION—ALTERNATIVE EMBODIMENTS

A multitude of alternative major embodiments will be explained in this section. Now, the utility of the present invention can be extracted from the set of examples provided in the last two sections. From this, another major marker embodiment, a playing card embodiment, and software embodiments easily follow.

In the above major embodiment, the following underlying question is repeatedly asked in all situations: "Which type of chess piece will be captured next according to the current example?" Our game provides a randomizing means for assigning a prediction that attempts to answer this question. A good prediction, and knowing when to agree with that prediction, rewards the player by providing a higher likelihood of scoring the corresponding captured chess piece. A not-so-good prediction has the opposite effect.

The luck function described above provides a randomizing means in the form of a single roll of chess dice. The resulting designations on the rolled chess dice assign the prediction so that the novice doesn't have to. This is very important because the novice shouldn't initially have the slightest idea what to predict. A completely random assignment in this case prevents the beginner from being frustrated by a prematurely complex decision. In this way, no chess knowledge is necessary for play to begin. Conditioning from play will follow, thus preventing premature discouragement that often accompanies the teaching of chess in a conventional way. Part of the beauty of the present invention is that initially the chess pieces appear to move in a random manner, each piece being a possible scoring opportunity. This entices the novice to pay attention to the examples, and gradually the chess pieces reveal their movement capabilities.

The skill functions described above extends a player's scoring opportunity into one that is partially dependent on skill. It allows players to use the randomizing means of the luck function a selectable number of times so that a player's scoring probability can be increased by knowing when to agree with the assigned prediction(s). This skill-based means for assigning a prediction requires the use of the randomizing means which is essential to our game. It gives players some control over the outcome of the game after some of the movement capabilities of the chess pieces have been deduced through example.

The guess capture and stampede processes provide a randomizing means in the form of rolling standard dice to achieve a random or pseudo-random marker positioning thereby assigning a more specific prediction of the type of chess piece which will be captured next. Knowing when to agree with an assigned prediction using these processes gives players additional skill-based means for biasing the scoring probability in their favor.

Major Marker Embodiment

This major marker embodiment of the present invention appears very much like the embodiment shown in FIG. 1. Here, aspects of the chess die 14 and standard die 16 are combined into one die having a number and a chess piece designation on each of its faces. Each player owns one color-coded marker 12 and one of these combination dice displaying a prevalent color that matches the marker. Also, the luck function spots 36 and the skill function spots 38 are removed from the game track 30. They are replaced by a universal function spot that combines aspects of the luck function and the first skill function. Some indexing system is used on the chess board 20 such as that shown in FIG. 2. Additionally, a chess-move storage device for storing representations of example chess movements consistent with the indexing system is implemented, such as the one shown in FIG. 3.

This embodiment is similar in function to the compound single-marker version of play as depicted in FIG. 6*a*. The rules of play are identical to those in FIG. 6*a* lip to the "Select option" decision and after the "End of chess game?" decision. At the "Select option" decision, the player has one option: to roll his/her combination die. The player can then move his/her marker in either direction on the game track 30 (FIG. 1) an amount specified by the number displayed on the top face of the die, or the player can place his/her marker on any chess symbol spot 34 (FIG. 1) that corresponds to the general type of designation displayed on the top face of the die.

The next question is "What did you land on?" If the current player's marker landed on a universal function spot located on the gametrack, he/she becomes the "mover" as shown in FIG. 4. The mover is designated a skill-based function, and all other players also become involved with the possibility of scoring the resulting captured piece through the use of a more luck-based function. More specifically, the universal function requires each player to first roll his/her combination die. The mover can then roll his/her die up to two more times. An update capture process (FIG. 4) then ensues, and the resulting captured piece is scored by the player whose combination die matches the captured piece. Ties here are resolved by a roll-off, and if the piece doesn't match any die, then it is placed by the mover anywhere in the corral 40 (FIG. 1).

If the current player's marker landed on a chess symbol spot 34, he/she then has the option of initiating a guess capture process as shown in FIG. 6*c*. In addition, if the player guessed correctly, he/she then invades the corral 40 (FIG. 1) by placing his/her marker within a corral protrusion adjacent to the spot the marker was currently occupying on the game track, and he/she may stay inside the corral until another player successfully guess captures, thereby forcing his/her marker back to its start spot 32. While inside the corral, the invading player may in proceeding turns push his/her marker in either direction an amount specified by the combination die, scoring all captured pieces in its path. The invading marker may leave the corral 40 and step onto the game track 30 at any point in its path.

The extended guess capture option of this embodiment may of course be left for a secondary level of play. It does, however, provide a very strong incentive for players to improve their predictions regarding which type of chess piece will be captured next, especially since all unscored pieces go directly to the corral and so a corral invasion can vastly help a player's total score. The universal function allows all players to simultaneously try to score, thus making this embodiment a particularly fun group experience. Also, each player can place his/her rolled combination die in its corresponding start spot 32 during a universal function for organizational purposes.

Playing Card Embodiment

All of the above marker embodiments use dice as the source of the randomizing means for assigning a capture prediction. The tangible manifestations of the prediction were specific chess piece designations on the game track and more general designations on the chess dice and combination dice. The luck function, skill functions, universal function, and guess capture process all initiated an update capture process that was immediately preceded by a player's marker landing on a spot on the game track. In this playing card embodiment of the present invention, all update capture processes are initiated by playing a card that displays a universal function designation or a chess piece designation. In other words, the source of the randomizing means here is playing cards.

Please refer now to FIG. 8. There is no game track for marker occupation here because there are no markers to place on it. A corral with corral symbols 108 replaces the corral 40 of FIG. 1 as a temporary storage device for containing unscored, captured chess pieces. Playing cards 100 are utilized instead of dice, markers, and a game track. Each card displays a designation resembling a type of chess piece, a universal function symbol, or a "Corral Invasion" symbol. Card placement involves using draw piles 102, play piles 104, discard piles 106, and holding some cards in hand. Some indexing system is used on the central chess board such as that shown in FIG. 2. Additionally, a chess-move storage device for storing representations of example chess movements consistent with the indexing system is implemented, such as the one shown in FIG. 3. Finally, a single invader token is introduced to indicate who, if anyone, is currently invading the corral. The player who owns this invader token scores any chess piece from the corral every time he/she discards a "Corral Invasion" card. Ownership of this token is explained below.

This embodiment is similar in function to the major marker embodiment described in the section immediately preceding this one. The rules of play are nearly identical to those in FIG. 6*a* up to the "Select option" decision and after the "End of chess game?" decision. One of the differences consists of replacing game track initialization with playing card initialization which consists of separating all playing cards into two stacks and placing them on the draw piles 102. The other difference is the roll-off at the end of the game. Here, playing cards drawn from the draw pile 102 indicate the winner of a simultaneous draw similar to a roll-off. Numerical values printed on the cards indicate the highest draw during this process.

Mid-game play begins with the first player's turn after game initialization. He/she draws a card from the nearest draw pile 102. Then the player may discard the card by placing it in nearest discard pile 106, "play" the card by placing it in the nearest play pile 104, or keep the card in hand if the player has less than three cards already in hand. If a universal function card is played, the player who drew it becomes the mover. Then all players draw one card from their nearest draw pile 102 and place it on top of the nearest play pile 104. Then, the mover may draw again up to two more times and place the drawn cards on top of his/her play pile 104. After this, the card on top of each play pile 104 represents each player's guess as to which type of chess piece will be captured next. An update capture process (FIG. 4) ensues, and the resulting captured piece is scored by the player whose guess matches the piece. Ties here are resolved by a simultaneous draw, and if the piece doesn't match any card, then it is placed by the mover on any corral symbol 108 that matches the piece. If there is no more room in the corral for that type of piece, the mover scores it anyway.

If the player plays a card that displays a type of chess piece on its front face, he/she initiates a guess capture process (FIG. 6*c*), with the played card being his/her guess. If the guess is correct, the player also is given ownership of the invader token until someone else does the same. This extended guess capture process entices players to accurately predict the next captured piece, thereby educating them in the game of chess. Still, the game winner is the player who has scored the most captured chess pieces after the simultaneous draw for each piece left in the corral.

Software Embodiments

All of the embodiments described up to this point can easily be simulated by software and represented on an electronic display device. Here, a computer memory is encoded with data that causes a computer to function like the game embodiments described above. No external indexing system is required, and the chess-move storage device is the computer memory. Every process other than a game decision is updated automatically. The chess pieces look like a combination between a chess piece and a dinosaur. When play is idle, the uncaptured Chessosaurs partially reveal their movement capabilities by head movements, etc.

Referring to FIG. 1, A hero figure replaces the playing marker 12. Chessosaur skeletons replace the generic chess piece representations on the game track 30. The randomizing means is displayed in the form of a die having three-dimensional skulls of various dinosaurs protruding from the faces of the die. A corral invasion involves a hero trying to defeat in some way the captured Chessosaurs in the hero's path, thereby scoring the captured Chessosaur.

Please refer now to FIG. 9. This embodiment demonstrates an extremely efficient software technique for improving visualization of the movement capabilities of standard chess pieces. An attacker 110 moves along the example path indicated. Before this movement resulted in a captured black pawn, a set of capture predictions were randomly assigned, one of which being correct. The person playing this game technique has the option to choose his prediction from this set. The prediction set depicted in FIG. 9 consists of some possible defenders 112 and the defender that was eventually captured, the black pawn. The captured piece is a score 116 if the player's selection from the set was correct and a no score 114 if the player was wrong.

It can be seen from the example capture sequence shown in FIG. 9 that at all points along the continuous path of the attacking white knight, none of the pieces from the prediction set besides the black pawn could have been captured. Therefore, at a slow enough speed, at some point the direction of the attacker and its proximity to the to-be-captured piece render the correct choice obvious to any player, skilled or not. Therefore, in this software embodiment, the randomizing means for assigning a prediction to which type of chess piece will be captured next is the uncertainty of scoring due to the speed of the automated example movement of the attacker, and the type of piece is more specifically the exact piece. The prediction set is useful because it allows the player to quickly choose from a reduced set using a controller such as a joystick, mouse, or keyboard.

The objective is to score as many captured pieces as possible in the amount of time allotted by the timer 120. A speed controller 122 controls an attacker's velocity along its example path, and a parallelism controller 124 controls the number of simultaneous attackers. Both controllers tend to allow for a higher scoring potential (and scoring uncertainty) if their functions are increased. At a high level of play, example chess movements are displayed at a rate that is very effective for improving visualization skills regarding how chess pieces move. One can see this benefit on a smaller scale by first playing a series of speed chess games, and then playing a longer game requiring deeper levels of visualization. The present invention's scoring system once again provides incentive for players of this embodiment to pay attention to the examples.

Of course, the appearance of these chess pieces do not have to be standard either. The pieces could be Chessosaurs, and the chosen prediction for the next captured piece could be selected by passing along a defense shield among the highlighted Chessosaurs in the prediction set. Also, the computer program may actually control of the speed and parallelism controller, thereby enabling the controllers to be hidden from view.

CONCLUSIONS, RAMIFICATIONS, AND SCOPE OF INVENTION

Accordingly, the reader will see that the game method and apparatus of this invention provide an extremely efficient and fun means for teaching the complex game of chess to young children, that is, by teaching through example. In addition, the novice's learning requirements before play can begin is confined to an extremely simple set of rules. Our invention even allows the learning of chess to be a group experience without chess-expert supervision and without making the game more complex.

Furthermore, our game has the additional advantages in that

- it teaches standard chess, not necessarily a variation thereof;
- it allows a game of chess to be played in a very short amount of time;
- it prevents win lop-sidedness by introducing the element of chance;
- it allows players to use their chess aptitude to their advantage;
- it provides a mechanism to teach advanced chess maneuvers and tactics;
- it visually conditions players to quickly locate possible chess movements.

Although the description above contains many specificities, these should not be construed as limiting the scope of the invention but as merely providing illustrations of some of the presently preferred embodiments of this invention. For example, our game's random or pseudo-random prediction for the type of chess piece that will be captured next may be in the form of any element or combination of elements in the table below.

| General | More Specific | Very Specific | |
|---|---|---|---|
| DARK PIECE | KING | LIGHT KING | DARK KING |
| | QUEEN | LIGHT QUEEN | DARK QUEEN |
| | ROOK | LIGHT ROOK | DARK ROOK |

-continued

| General | More Specific | Very Specific | |
|---|---|---|---|
| LIGHT PIECE | BISHOP | LIGHT BISHOP | DARK BISHOP |
| | KNIGHT | LIGHT KNIGHT | DARK KNIGHT |
| | PAWN | LIGHT PAWN | DARK PAWN |

An extremely specific extension beyond this was demonstrated in the last software embodiment description where individual chess pieces were highlighted by the prediction set and further selected by the characteristics of an attacker's continuous path to the to-be-captured piece. Ramifications of the present invention extend from this utility and are described below.

Randomized Prediction and Scoring

The randomized prediction does not have to necessarily be made with dice, pseudo-randomized marker positioning on a gametrack, playing cards, etc. The prediction can be made by any randomizing device such as a spinner or even a dartboard (or chess dice without markers and a game track, etc). Unlike the prior art, the randomizing means of the present invention selects a piece for a score/no score decision instead of a piece for a movement decision that must follow chess rules, thereby vastly eliminating degrees of freedom that would otherwise require a significant amount of learning overhead before play could begin. Our game provides a small number of degrees of freedom in the form of the skill-based means (the universal function, skill functions, guess captures, stampede process, etc.) described above which bias the outcome of each game through the use of the lower level randomizing means.

Our game's scoring mechanism utilizes captured chess pieces from example chess movements. The scoring elements are these captured pieces, which provide a convenient means for making players pay attention to the examples. However, scoring does not necessarily have to be as direct or efficient. A player's scoring elements can be multiplied by conversion factors for different pieces and different situations to arrive at a cumulative score that is not the same as a sum of the player's scoring elements. A software embodiment may also choose this approach since scoring can be completely automated. The event of a chess piece being captured is the software equivalent of the tangible chess piece becoming a scoring piece. Scoring elements can change form when utilized in software, but their function essentially remains the same.

The randomizing means provide uncertainty in scoring, thereby creating a playing atmosphere which promotes the fascinating potential of each chess piece. Furthermore, this can be achieved without knowing the slightest thing about chess because play is so simple and because the randomizing means gives every player a fair chance of winning regardless of their chess knowledge.

Recall

Recall is the aspect of our chess-like game that reduces the amount of learning necessary before play can begin. Example chess movements are recalled from a chess-move storage device and physically implemented on the chess board. This demonstrates the game of chess. The present invention's randomizing means and scoring means then make players pay attention to each demonstration without requiring too much concentration.

The chess-move storage device shown in FIG. 3 stores example chess move information. Recalling the movements from this is simply a matter of rotating the game disk 50 and viewing the next move element 62 that appears through the move viewport 94. Its operational efficiency is partly due to the viewport's restriction to a single circular path instead of a multi-dimensional area. The disk holder 70 acts as a rotational conductor of the game disk 50. It can be constructed so that, instead of filling the disk hole 52, it partially surrounds and secures the outer edges of the disk, thereby still functioning as a rotational conductor. It also can be constructed so that it restricts the disk to one direction of rotation and click as the disk rotates.

Rectangular cards displaying printed move elements and magazine images with cartoon characters (indexing individual chess pieces to move to a certain square) are some of the obvious ramifications regarding this storage part of the present invention. An electronic board game with an automated indication of which piece to move where is another option. A story-like narrative describing fictional characters (which represent chess pieces) moving on the chess board is also possible. There are so many more obvious possibilities that no further attempt will be made at describing how to store and rsecall organized information.

The indexing system shown in FIG. 2 is a very efficient example amongst a vast number of possibilities for locating a position on the chess board. However, we have determined that the task of operating the storage device during recall and the task of manipulating the indexed piece are utilized more effectively if they are distributed between two players. These players carry out an update capture process (FIG. 4) very effectively with the use of the indexing system in FIG. 2 and the rotary device in FIG. 3.

Example movements during recall can demonstrate a single piece moving more than one time in a row, etc., just as long as each individual movement conforms to the corresponding movement capabilities allowed by the moved chess piece. The chess-move storage device can also display a roll indicator that indicates to the "mover" during the execution of a universal or skill function when he/she may roll again if he/she desires. An update capture process can be halted before a chess piece is captured or continued until multiple chess pieces are captured. It can even be played in reverse.

Software

Software embodiments don't require an indexing system on the chess board or a manually operated storage device because recall is automated. However, the utility of our game remains essentially the same for software embodiments. Numerous examples are generated and a randomized prediction is assigned for each to-be-captured piece. Each of these pieces becomes a scoring element after it is captured, and a player's probability of scoring that scoring element is higher if he/she knows when to agree with the randomized prediction. Players may have some control over the movement of the uncaptured chess pieces here because an example continuation from this can automatically be generated. Artistic attempts can also be made to add interactive dynamics such as allowing a hero to travel on the chess board during automated example movements.

Other Ramifications

The chess board can be smaller and the chess set reduced, like Petty Chess described above. The maximum number of players are also variable. The appearance of the chess pieces can range anywhere from standard pieces to Chessosaurs to cartoon characters to Santa's elves. The order and number of chess piece designations on the game track is variable, etc. The game track can be constructed so as to provide a template for the incorporation of puzzle-like pieces which allow for a variable functioning track. Pawns can be constructed so that they are volumetric subsets of queens attachable to a second piece which, upon queening, resembles a queen.

Scope

Chess has been around for many centuries, and it has always subjected the beginner to a significant amount of learning overhead before play could even begin. The present invention combines a new use for captured chess pieces with a new use for randomly selecting a type of chess piece. This actually allows the beginner to gradually appreciate and understand the game of chess while playing a simple yet exciting game.

Thus the scope of the invention should be determined by the appended claims and their legal equivalents, rather than by the examples given.

We claim:

1. A chess-like game designed to teach chess through example, comprising:

(a) a gameboard having a grid of spaces on the surface thereon, said grid representing a chess board;

(b) two sets of distinguishable playing pieces, each of said sets having a plurality of playing pieces and including less than seven playing pieces being identifiable from one another, the movements of said playing pieces on said grid being defined according to a predetermined set of game rules, said identifiable playing pieces having movements equivalent to those of pieces selected from the group consisting of the king, queen, rook, knight, bishop, and pawn in the game of chess, (c) chess-move storage device for storing representations of example movements of said playing pieces on said grid, said example movements restricted to those allowed in said predetermined set of game rules, said example movements forming sequential moves of an example chess game, said storage device highlighting the current move, (d) a set of scoring elements, comprising captured playing pieces, said scoring elements being the result of said example movements, said scoring elements being identifiable from said playing pieces by an organized positioning of said scoring elements beyond the bounds of said grid, whereby the positions of said playing pieces on said grid are updated and recalled according to said example movements, the resulting captured pieces being used as scoring elements so that players are given incentive to pay attention to the examples.

2. The chess-like game in accordance with claim 1, further including a randomizing means for selecting a subset of said playing pieces.

3. The chess-like game in accordance with claim 2, wherein said randomizing means includes a plurality of playing markers and a multitude of marker spaces having designations thereon representing various ones of said playing pieces, said playing markers capable of occupying said marker spaces, said marker spaces located near and encircling said grid.

* * * * *